US011715880B2

(12) United States Patent
Bongard et al.

(10) Patent No.: US 11,715,880 B2
(45) **Date of Patent: *Aug. 1, 2023**

(54) WAVEGUIDE FEED NETWORK ARCHITECTURE FOR WIDEBAND, LOW PROFILE, DUAL POLARIZED PLANAR HORN ARRAY ANTENNAS

(71) Applicant: VIASAT, Inc., Carlsbad, CA (US)

(72) Inventors: Frederic Bongard, Pully (CH); Stefano Vaccaro, Gland (CH)

(73) Assignee: Viasat Inc., Carlsbad, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/586,578

(22) Filed: Jan. 27, 2022

(65) Prior Publication Data

US 2022/0149530 A1 May 12, 2022

Related U.S. Application Data

(63) Continuation of application No. 17/157,722, filed on Jan. 25, 2021, now Pat. No. 11,276,937, which is a (Continued)

(51) Int. Cl.
*H01Q 5/55* (2015.01)
*H01Q 13/02* (2006.01)
(Continued)

(52) U.S. Cl.
CPC ..... *H01Q 13/0233* (2013.01); *H01Q 5/55* (2015.01); *H01Q 21/0025* (2013.01);
(Continued)

(58) Field of Classification Search
CPC ..... H01Q 13/0233; H01Q 13/0241; H01Q 13/02; H01Q 5/55; H01Q 21/0025;
(Continued)

(56) References Cited

U.S. PATENT DOCUMENTS 4,126,835 A 11/1978 Gould
4,395,685 A 7/1983 Davies et al.
(Continued)

FOREIGN PATENT DOCUMENTS

KR 10-2011-0069386 6/2011
KR 20110069386 * 6/2011
WO WO 2015/134772 A1 9/2015

OTHER PUBLICATIONS

International Search Report and Written Opinion mailed in International Application No. PCT/US2015/019007 dated Jun. 11, 2015, 10 pgs.

(Continued)

*Primary Examiner* — Awat M Salih
(74) *Attorney, Agent, or Firm* — Holland & Hart LLP

(57) ABSTRACT

A waveguide structure for a compact and scalable dual-polarized antenna array. In one example, a waveguide device comprises septum polarizers dividing common waveguides into first waveguides associated with a first polarization and second waveguides associated with a second polarization. The sets of septum polarizers may be inverted relative to each other to form first groups of four adjacent first waveguides for each type of waveguide. The waveguide device may also include a waveguide feed network including a first waveguide feed stage including waveguide combiner/dividers coupled between the four adjacent waveguides intermediate waveguides. The waveguide device may further include a second waveguide feed stage coupled with the first intermediate waveguides and the second intermediate waveguides, wherein the second waveguide feed stage extends in a direction perpendicular to the first waveguide feed stage.

17 Claims, 19 Drawing Sheets

Related U.S. Application Data continuation of application No. 16/129,528, filed on Sep. 12, 2018, now Pat. No. 10,931,020, which is a continuation of application No. 15/123,535, filed as application No. PCT/US2015/019007 on Mar. 5, 2015, now Pat. No. 10,096,904.

(60) Provisional application No. 61/949,008, filed on Mar. 6, 2014.

(51) Int. Cl.

| | |
|---|---|
| ***H01Q 21/00*** | (2006.01) |
| ***H01Q 21/24*** | (2006.01) |
| ***H01Q 25/00*** | (2006.01) |
| ***H01Q 21/06*** | (2006.01) |
| *H01P 1/17* | (2006.01) |
| *H01P 5/12* | (2006.01) |

(52) U.S. Cl.

CPC ..... *H01Q 21/064* (2013.01); *H01Q 21/24* (2013.01); *H01Q 21/245* (2013.01); *H01Q 25/001* (2013.01); *H01P 1/173* (2013.01); *H01P 5/12* (2013.01); *H01Q 13/02* (2013.01); *H01Q 13/0241* (2013.01); *H01Q 21/0087* (2013.01)

(58) Field of Classification Search

CPC .... H01Q 21/064; H01Q 21/24; H01Q 21/245; H01Q 21/0087; H01Q 25/001; H01P 1/173; H01P 1/12

See application file for complete search history.

(56) References Cited

U.S. PATENT DOCUMENTS

| | | | | |
|---|---|---|---|---|
| 6,703,976 | B2 | 3/2004 | Jacomb-Hood | |
| 7,564,421 | B1 * | 7/2009 | Edwards ..... | H01Q 21/0087 343/778 |
| 7,567,421 | B2 | 7/2009 | Miyashita | |
| 2003/0030590 | A1 | 2/2003 | Gau et al. | |
| 2011/0267250 | A1 * | 11/2011 | Seifried ..... | H01Q 13/0258 343/776 |
| 2013/0120086 | A1 | 5/2013 | Sarasa Delgado | |

OTHER PUBLICATIONS

International Search Report and Written Opinion mailed in International Application No. PCT/US2015/019007 dated Sep. 6, 2016, 8 pgs.

* cited by examiner

WAVEGUIDE FEED NETWORK ARCHITECTURE FOR WIDEBAND, LOW PROFILE, DUAL POLARIZED PLANAR HORN ARRAY ANTENNAS

CROSS REFERENCE TO RELATED APPLICATIONS

The present Application for Patent is a Continuation of U.S. patent application Ser. No. 17/157,722 by Bongard et al., entitled "Waveguide Feed Network Architecture For Wideband, Low Profile, Dual Polarized Planar Horn Array Antennas" filed Jan. 25, 2021, which is a Continuation of U.S. patent application Ser. No. 16/129,528 by Bongard et al., entitled "Waveguide Feed Network Architecture For Wideband, Low Profile, Dual Polarized Planar Horn Array Antennas" filed Sep. 12, 2018, which is a Continuation of U.S. patent application Ser. No. 15/123,535 by Bongard, et al., entitled Waveguide Feed Network Architecture For Wideband, Low Profile, Dual Polarized Planar Horn Array Antennas," filed Sep. 2, 2016, which is a 371 of International Patent Application No. PCT/US2015/019007 by Bongard, et al., entitled "Waveguide Feed Network Architecture For Wideband, Low Profile, Dual Polarized Planar Horn Array Antennas" filed Mar. 5, 2015 and claims priority to U.S. Provisional Application No. 61/949,008, entitled "Waveguide Feed Network Architecture for Wideband, Low Profile, Dual Polarized Planar Horn Array Antennas," which was filed on Mar. 6, 2014, the contents of each of which are hereby incorporated by reference herein for any purpose in their entirety.

BACKGROUND

A passive array technology using antenna arrays including waveguide or horn apertures with waveguide feed networks are becoming an important communication tool because such antenna arrays exhibit low level of losses. These antenna arrays represent one of the most suited technologies for passive arrays because of the low level of losses they exhibit. Applications requiring a significant bandwidth may use feed networks of the corporate type in order to provide equal amplitude and phase to all the elements in the array. As the number of antenna elements increases, the waveguide feed networks become increasingly complex and space consuming. This can be problematic in many environments (e.g., avionics) where space and/or weight are at a premium. In some cases, inter-element distance may be constrained by the feed network size, which may degrade antenna performance.

A common problem with this type of architecture is the occurrence of grating lobes in the radiation pattern of the array, which happens if the inter-element distance is too large. Indeed, the fact that rectangular waveguides occupy more lateral space than other types of transmission medium (e.g., microstrip, etc.) makes it difficult to bring the antenna elements sufficiently close to each other such that grating lobes are avoided. This limitation can be even more severe with dual-polarized arrays, where the feed network system handles two channels, for the two orthogonal polarizations. Current architectures of antenna arrays using waveguide or horn aperture elements makes it difficult to maintain a desired inter-element distance with a compact waveguide feed structure.

SUMMARY

Methods, systems, and devices are described for a waveguide feed architecture for a dual polarized planar antenna array. The waveguide feed architecture may include planar waveguide feed networks that reduce the overall size of antenna array. The waveguide feed architecture may also include septum polarizers to create dual polarization. The septum polarizers may be oriented in such a way that waveguides for the same type of polarization can be grouped together in an efficient manner to reduce the size of the antenna array. A first waveguide feed stage of the waveguide feed network may be integral with the septum polarizers.

In a first set of illustrative examples, a waveguide device for a dual-polarized antenna array is described. In one configuration, the waveguide device includes a plurality of septum polarizers dividing common waveguides into first waveguides associated with a first polarization and second waveguides associated with a second polarization, wherein a first set of the plurality of septum polarizers is inverted relative to a second set of the plurality of septum polarizers to form first groups of four adjacent first waveguides of the first waveguides, and to form second groups of four adjacent second waveguides of the second waveguides. The waveguide device may also include a waveguide feed network. The waveguide feed network further includes a first waveguide feed stage comprising a first plurality of waveguide combiner/dividers coupled between the four adjacent first waveguides of the first groups and first intermediate waveguides and a second plurality of waveguide combiner/dividers coupled between the four adjacent second waveguides of the second groups and second intermediate waveguides, wherein the first waveguide feed stage extends in parallel with the plurality of septum polarizers. The waveguide feed network may also include a second waveguide feed stage coupled with the first intermediate waveguides and the second intermediate waveguides, wherein the second waveguide feed stage extends in a direction perpendicular to the first waveguide feed stage.

The second waveguide feed stage of the waveguide device may also include a first feed network coupled with the first intermediate waveguides and a second feed network coupled with the second intermediate waveguides. The first feed network may further include a third plurality of waveguide combiner/dividers coupled between the first intermediate waveguides and a first feed network port of the waveguide feed network. The second feed network may further include a fourth plurality of waveguide combiner/dividers coupled between the second intermediate waveguides and a second feed network port of the waveguide feed network. The second waveguide feed stage may also include a third feed network including a fifth plurality of waveguide combiner/dividers coupled with the first feed network port of the waveguide feed network and coupled with at least one other waveguide feed network associated with a second plurality of septum polarizers. The second waveguide feed stage may also include a fourth feed network including a sixth plurality of waveguide combiner/dividers coupled with the second feed network port of the waveguide feed network and coupled with the at least one other waveguide feed network associated with the second plurality of septum polarizers.

In some examples of the waveguide device, at least a portion of the first feed network is located between the first intermediate waveguides and the second feed network. In other examples of the waveguide device, the first and second feed networks comprise a plurality of 2 to 1 waveguide combiner/dividers.

The first polarization may be a right-handed circular polarization and the second polarization may be a left-handed circular polarization. In other examples, the first polarization may be a first linear polarization and the second polarization may be a second linear polarization orthogonal to the first linear polarization.

In additional examples of the waveguide device, the first waveguide feed stage of the waveguide feed network is integral with the plurality of septum polarizers. In some examples, the first and second waveguide feed stages of the waveguide feed network comprise corporate feed networks. The waveguide device may also include a plurality of horn radiating elements, each horn radiating element associated with a different septum polarizer. In some examples, each septum polarizer of the plurality of septum polarizers is located a same inter-element distance from at least two adjacent septum polarizers of the plurality of septum polarizers. In further examples, the antenna array is a lattice antenna array, the first set of the plurality of septum polarizers include odd rows of the lattice antenna array, and the second set of the plurality of septum polarizers comprise even rows of the lattice antenna array.

In a second set of illustrative examples, an antenna array is described. In one configuration, the antenna array may include an array of antenna elements including a plurality of septum polarizers dividing common waveguides into first waveguides associated with a first polarization and second waveguides associated with a second polarization, wherein a first set of the plurality of septum polarizers is inverted relative to a second set of the plurality of septum polarizers to form first groups of four adjacent first waveguides of the first waveguides, and to form second groups of four adjacent second waveguides of the second waveguides. The antenna array may also include a waveguide feed network coupled with the array of antenna elements. The waveguide feed network may include a first waveguide feed stage and a second waveguide feed stage. The first waveguide feed stage includes a first plurality of waveguide combiner/dividers coupled between the four adjacent first waveguides of the first groups and first intermediate waveguides and a second plurality of waveguide combiner/dividers coupled between the four adjacent second waveguides of the second groups and second intermediate waveguides, wherein the first waveguide feed stage extends in parallel with the plurality of septum polarizers. The second feed stage is coupled with the first intermediate waveguides and the second intermediate waveguides and may extend in a direction perpendicular to the first waveguide feed stage.

Further scope of the applicability of the described methods and apparatuses will become apparent from the following detailed description, claims, and drawings. The detailed description and specific examples are given by way of illustration only, since various changes and modifications within the scope of the description will become apparent to those skilled in the art.

BRIEF DESCRIPTION OF THE DRAWINGS

A further understanding of the nature and advantages of embodiments of the present disclosure may be realized by reference to the following drawings. In the appended figures, similar components or features may have the same reference label. Further, various components of the same type may be distinguished by following the reference label by a dash and a second label that distinguishes among the similar components. If only the first reference label is used in the specification, the description is applicable to any one of the similar components having the same first reference label irrespective of the second reference label.

DETAILED DESCRIPTION

Figure 1:
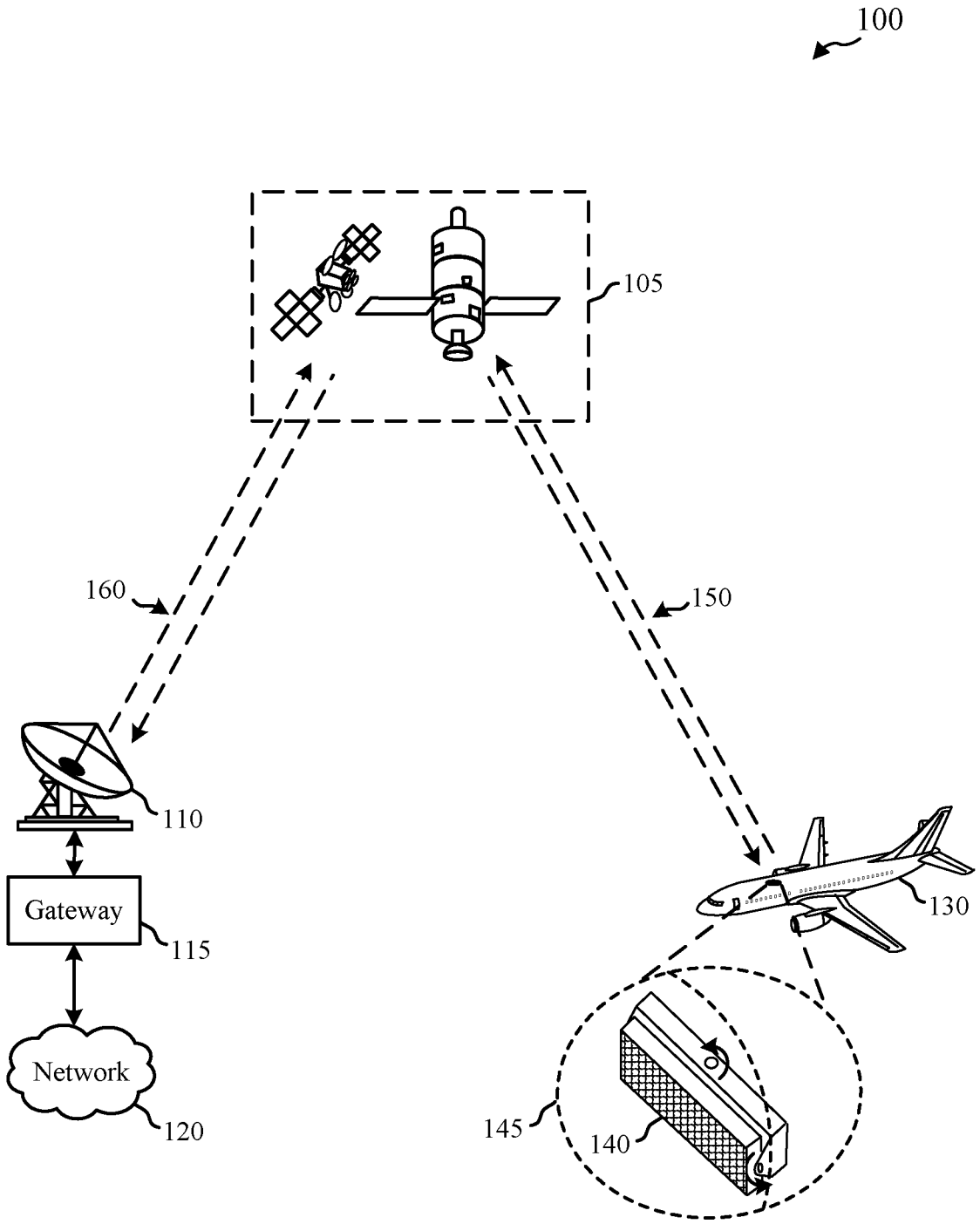
FIG. 1 shows a diagram of a wireless communication system in accordance with various embodiments.

The described features generally relate to a waveguide or horn aperture antenna array and waveguide feed architecture for a dual polarized antenna array (referred to herein as "antenna array" or simply "array"). The last stage of the feed network is the stage closest to the radiating elements of the array. The waveguide feed architecture described herein enables the radiating elements of the array to be sufficiently close together in order to substantially reduce grating lobes in the radiating pattern of the array. The waveguide feed architecture also creates a compact design that allows for a low profile, extendable array.

This description provides examples, and is not intended to limit the scope, applicability or configuration of embodiments of the principles described herein. Rather, the ensuing description will provide those skilled in the art with an enabling description for implementing embodiments of the principles described herein. Various changes may be made in the function and arrangement of elements.

Thus, various embodiments may omit, substitute, or add various procedures or components as appropriate. For instance, it should be appreciated that the methods may be performed in an order different than that described, and that various steps may be added, omitted or combined. Also, aspects and elements described with respect to certain embodiments may be combined in various other embodiments. It should also be appreciated that the following systems, methods, devices, and software may individually or collectively be components of a larger system, wherein other procedures may take precedence over or otherwise modify their application.

For antenna arrays using waveguide or horn aperture elements, it may be desirable to feed a large number of antenna elements using continuous waveguide combiner/divider networks (e.g., with no changes in propagation medium). In addition, for dual-polarized antenna arrays, multiple separate waveguide combiner/divider networks may be interleaved to feed different polarization ports of each antenna element. These waveguide combiner/divider networks may be complex and may limit how close the antenna elements can be to each other. In addition, such waveguide combiner/divider networks may include several stages that extend back behind the aperture plane of the antenna array, increasing the depth of the antenna dramatically as the array size increases. In some applications, the depth of the antenna may be constrained by a physical enclosure (e.g., radome, etc.), and thus the overall depth of the waveguide combiner/divider networks may limit the number of antenna array elements that can be used, thus limiting performance of the antenna array. The antenna array and waveguide combiner/divider structures described herein provide a compact dual-polarized antenna array and waveguide combiner/divider network that achieves reduced inter-element distance in a scalable architecture.

Antenna arrays as described herein may include continuous waveguide medium corporate waveguide combiner/divider networks that are compact and reduce inter-element distance. The antenna array may include an array of septum polarizers. The septum polarizers may be connected to radiating elements (e.g., waveguide apertures, horn apertures, etc.) and may combine or generate different polarizations (e.g., right-handed and left-handed circular polarization) in the radiating aperture. Each row (or column) of the array may have the septum polarizers in an orientation that is inverted from the orientation of the septum polarizers in adjacent rows (or columns) of the array. That is, the septum polarizers in one row of antenna elements over two are flipped. The inverted septum polarized structure enables adjacent divided waveguides of the same polarization type to be grouped together. For example, the groups of divided waveguides may have a two-by-two (2×2) structure, grouping four divided waveguides of the same polarization from the array of septum polarizers together. The groups of divided waveguides may be combined using 1-to-4 feed modules.

The waveguide feed network may include two waveguide feed stages. The first stage may include waveguide combiner/dividers and intermediate waveguides associated with each polarization. The first waveguide feed stage may be of the corporate type. The second waveguide feed stage may include two separate feed networks coupled with the intermediate waveguides of each polarization. The second waveguide feed stage may be planar and of the corporate type. This structure may provide for a low profile antenna array having a compact size. The first stage may generally have a waveguide propagation direction that is perpendicular to the waveguide propagation direction in the second stage.

Further, the antenna array may operate over a wide bandwidth. The antenna array is also scalable, such that multiple antenna sub-arrays may be combined into a larger antenna array. The size of the elements in the antenna array may be scaled larger or smaller for different frequency bands. In some embodiments, the antenna elements, first waveguide combiner/divider network, and intermediate waveguides for an antenna sub-array may be manufactured as an integral component (e.g., formed as a single component).

FIG. 1 shows a diagram of a satellite communication system 100 in accordance with various embodiments. The satellite communication system 100 includes a satellite system 105, a gateway 115, a gateway antenna system 110, and an aircraft 130. The gateway 115 communicates with one or more networks 120. In operation, the satellite communication system 100 provides for two-way communications between the aircraft 130 and the network 120 through the satellite system 105 and the gateway 115.

The satellite system 105 may include one or more satellites. The one or more satellites in the satellite system 105 may include any suitable type of communication satellite. In some examples, some or all of the satellites may be in geosynchronous orbits. In other examples, any appropriate orbit (e.g., low earth orbit (LEO), etc.) for satellite system 105 may be used. Some or all of the satellites of satellite system 105 may be multi-beam satellites configured to provide service for multiple service beam coverage areas in a predefined geographical service area.

The gateway antenna system 110 may be two-way capable and designed with adequate transmit power and receive sensitivity to communicate reliably with the satellite system 105. The satellite system 105 may communicate with the gateway antenna system 110 by sending and receiving signals through one or more beams 160. The gateway 115 sends and receives signals to and from the satellite system 105 using the gateway antenna system 110. The gateway 115 is connected to the one or more networks 120. The networks 120 may include a local area network (LAN), metropolitan area network (MAN), wide area network (WAN), or any other suitable public or private network and may be connected to other communications networks such as the Internet, telephony networks (e.g., Public Switched Telephone Network (PSTN), etc.), and the like.

The aircraft 130 includes an on-board communication system including a dual polarized planar horn antenna array 140 (also referred to herein as "antenna array 140"). The aircraft 130 may use the antenna array 140 to communicate with the satellite system 105 over one or more beams 150. The antenna array 140 may be mounted on the outside of the fuselage of aircraft 130 under a radome 145. The antenna array 140 may be mounted to an elevation and azimuth gimbal which points the antenna array 140 (e.g., actively tracking) at a satellite of satellite system 105. The depth of the antenna array 140 may directly impact the size of the radome 145, for which a low profile may be desired. In other examples, other types of housings are used with the antenna array 140. The antenna array 140 may operate in the International Telecommunications Union (ITU) Ku, K, or Ka-bands, for example from 17.7 to 21.2 Giga-Hertz (GHz). Alternatively, the antenna array 140 may operate in other frequency bands such as C-band, X-band, S-band, L-band, and the like. Additionally, the antenna array 140 may be used in other applications besides onboard the aircraft 130, such as onboard boats, vehicles, or on ground-based stationary systems.

Figure 2:
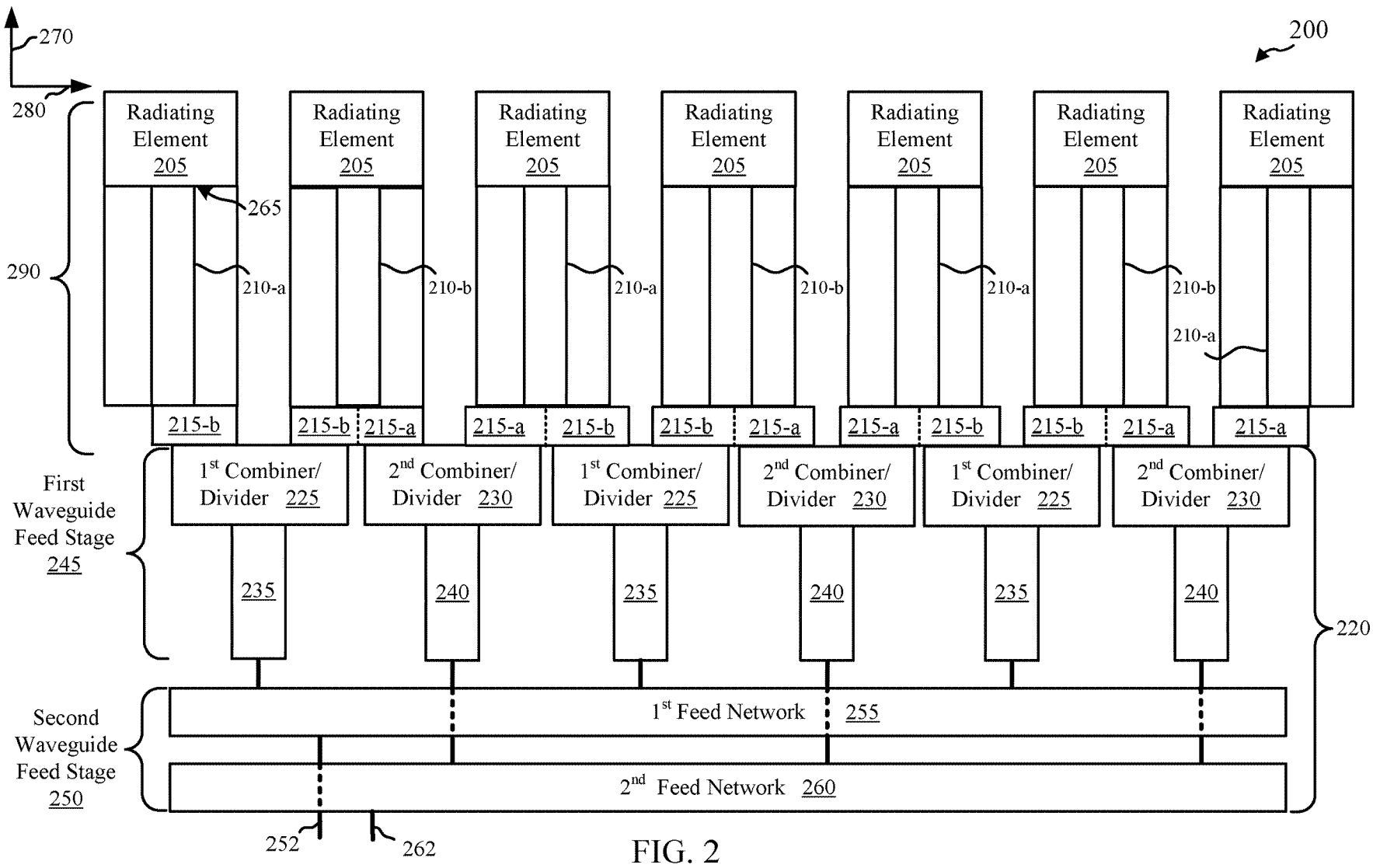
FIG. 2 illustrates a conceptual diagram of a waveguide device for a dual polarized planar horn antenna array in accordance with various embodiments.

FIG. 2 illustrates a conceptual diagram of a waveguide device 200 for a dual polarized planar horn antenna array in accordance with various embodiments. The waveguide device 200 may be an example of a component of the dual polarized planar horn antenna array 140 of FIG. 1. The waveguide device 200 may be part of an antenna array installed onboard an aircraft, such as aircraft 130 of FIG. 1, or may be used with other devices or systems. In some examples, the elements of waveguide device 200 may be arrayed in a rectangular antenna array, although the elements or arrays of elements may have other shapes or configurations.

FIG. 2 illustrates the waveguide device 200 as separate components in order to discuss the functionality of each waveguide section separately. For example, the waveguide device 200 may illustrate waveguide propagation paths where electromagnetic waves can propagate through and be directed between various waveguide sections, based on the structure of the waveguide device 200. The waveguide device 200 may include multiple waveguide combiner/divider networks associated with different polarizations. Half of the networks may correspond to radiation having one polarization (e.g., right-hand circular polarization) and the other half of the networks may correspond to radiation having another polarization (e.g., left-hand circular polarization).

The waveguide device 200 includes multiple antenna elements 290 in an array structure. Each antenna element 290 may include a radiating element 205, a polarization duplexer 210, and divided waveguides 215. The antenna elements 290 may have waveguide propagation paths generally aligned along z-axis 270. The divided waveguides 215 may also be referred to herein as "waveguide ports." While the radiating elements 205 are described herein as "radiating" electromagnetic radiation, they may also receive electromagnetic radiation. The radiating elements 205 may each be coupled with one of the polarization duplexers 210. The radiating elements 205 may be horns or waveguide apertures. In examples where the radiating elements 205 are horns, the horns may be square, circular, or any other shape allowing reception and transmission of any desired polarized electromagnetic signal. The radiating elements 205 may also be loaded with dielectric bodies.

The polarization duplexers 210 may be coupled between the radiating elements 205 and divided waveguides 215 and may generate polarization for transmission at the radiating elements 205. The polarization duplexers 210 are generally described herein as septum polarizers 210, although described aspects may be applied with other types of polarization duplexers. The conducting surfaces of septum polarizers 210 may be formed using a conductive material such as metal, or may be metal-plated. The septum polarizers 210 may be designed to generate linear or circular polarization. In one example, the septum polarizers 210 have a metallic staircase design that generates right-handed circular polarization (RHCP) and left-handed circular polarization (LHCP) for radiation.

The antenna elements 290 may include a common waveguide port 265 coupled with the radiating element 205. The common waveguide port 265 may carry differently polarized electromagnetic radiation (e.g., generated or combined by passing along the septum polarizers 210 from the separate divided waveguides 215) to be emitted by the radiating elements 205. Similarly, for a scenario where the radiating elements 205 receive electromagnetic radiation, the common waveguide port 265 carries the electromagnetic radiation to be divided into two separate paths associated with different polarizations by the septum waveguides 210.

The septum polarizers 210 may be coupled between the common waveguide port 265 and the divided waveguides 215. The septum polarizers 210 may receive two signals corresponding to two different polarizations via the divided waveguides 215 and combine the signals in a common waveguide for transmission via the radiating element 205. The septum polarizers 210 may also generate different polarizations for a dual-polarized antenna array. For example, a septum polarizer 210 may accept a signal (e.g., a first linearly polarized signal) at a first divided waveguide port 215-*a* and generate a first circular polarization (e.g., LHCP) at the common waveguide port 265. The septum polarizer 210 may accept a second signal (e.g., a second linearly polarized signal) at a second divided waveguide port 215-*b* and generate a second circular polarization (e.g., RHCP) at the common waveguide port 265. Similarly, a circularly polarized wave having the first polarization entering the common waveguide port 265 may be translated to a linearly polarized signal at the first divided waveguide port 215-*a*. That is, the energy from a wave having the first circular polarization that is received at the common waveguide port 265 will be transferred to the first divided waveguide port 215-*a* as a linearly polarized signal (assuming polarization duplexing). A circularly polarized wave having the second polarization entering the common waveguide port 265 will be translated to a linearly polarized signal at the second divided waveguide port 215-*b*. In some instances, the septum polarizers 210 may operate in a transmission mode for a first polarization (e.g., LHCP) while operating in a reception mode for a second polarization (e.g., RHCP).

The septum polarizers 210 may be divided into a two sets—a first set of septum polarizers 210-*a* and a second set of septum polarizers 210-*b*. The first set of septum polarizers 210-*a* may have a first orientation in the waveguide device 200 and the second set of septum polarizers 210-*b* may have a second orientation in the waveguide device 200. The second orientation may be opposite, or inverted, from the first orientation. The first and second sets of septum polarizers 210 may be arranged into separate and alternating rows of the waveguide device 200, where FIG. 2 illustrates one column of the waveguide device 200. Thus, the waveguide device 200 may include a first row having septum polarizers 210-*a*, an adjacent second row having septum polarizers 210-*b*, a third row adjacent to the second row having septum polarizers 210-*a*, and so on. As illustrated in FIG. 2, interleaving the rows of septum polarizers 210 results in divided waveguide ports 215 corresponding to the same polarization being adjacent to one another in adjacent rows.

The waveguide feed network 220 is coupled with the divided waveguides 215. The waveguide feed network 220 includes a first waveguide feed stage 245 and a second waveguide feed stage 250. The first waveguide feed stage 245 has a waveguide propagation direction substantially along the z axis 270, which may be perpendicular with an aperture plane of the radiating elements 205. The second waveguide feed stage 250 has a waveguide propagation direction substantially orthogonal to the z-axis 270 (e.g., along the x-axis 280 or y-axis).

The first waveguide feed stage 245 includes a first set of combiner/dividers 225 and a second set of combiner/dividers 230. Each set of combiner/dividers 225, 230 combine the divided waveguides 215 corresponding to the same polarization. For example, the first set of combiner/dividers 225 may be coupled with the divided waveguides 215 associated with the first polarization and the second set of combiner/dividers 230 may be coupled with the common divided waveguides 215 associated with the second polarization. In one particular example, the first set of combiner/dividers 225 are coupled with divided waveguides 215 associated with RHCP signals. Congruently, the second set of combiner/dividers 230 are coupled with divided waveguides 215 associated with LHCP signals. This configuration may enable the waveguide device 200 to be smaller and more efficiently arranged.

The first and second set of combiner/dividers 225, 230 may be arranged in the waveguide device 200 as a pattern of alternating rows. Each combiner/divider 225, 230 internal to the waveguide device 200 (i.e., not along the edge of the waveguide device 200) may be connected to at least two adjacent divided waveguides. For example, a combiner/divider 225 may be attached to the sides of four different adjacent divided waveguides 215 that correspond to the RHCP signals while a combiner/divider 230 may be attached to the sides of four different adjacent divided waveguides 215 that correspond to the LHCP signals. Those combiner/dividers 225, 230 that are on the outer edge of the waveguide device 200 may be coupled with two adjacent waveguides or the divided waveguides 215 at the outer edge may be terminated. When multiple waveguide devices 200 are combined into a larger antenna array, the divided waveguides 215 on the edges of a single waveguide device 200 may be combined with other divided waveguides on an edge of another waveguide device.

The waveguide device 200 may also include a set of intermediate waveguides 235 and 240. The intermediate waveguides 235 may be coupled with the first set of the combiner/dividers 225. The intermediate waveguides 240 may be coupled with the second set of the combiner/dividers 230. The intermediate waveguides 235, 240 may have a waveguide propagation direction substantially along the z-axis 270.

The waveguide device 200 may include two distinct feed networks that each combine/divide all of one type of polarization. A first feed network 255 may be coupled with the intermediate waveguides 235. The first feed network 255 may be a feed network for the polarization corresponding to the divided waveguides 215-*b*, for example. The first feed network 255 may be coupled between intermediate waveguides 235 and a first device port 252. A second feed network 260 may be coupled between intermediate waveguides 240 and a second device port 262. The second feed network 260 may be a feed network for the polarization corresponding to the divided waveguides 215-*a*, for example. The feed networks 255, 260 may include substantially planar waveguides and may have waveguide propagation substantially orthogonal to the z-axis 270.

In some examples, the feed networks 255, 260 may be corporate feed networks. A corporate feed network may be a feed network having a topology where each waveguide is divided, and each branch of the divided waveguide is further divided, and so on. For example, a waveguide may be divided by two, and then each branch is divided by two, and then each sub-branch is further divided by two to form the feed network structure. In other examples, the waveguides for the corporate feed network may be divided by other numbers. Corporate feed networks may be selected for the feed networks 255, 260 for their wide broadband properties. In a different embodiment, one or more of the feed networks 255, 260 may be non-corporate type feed networks (e.g., series feed networks, etc.).

The components of the waveguide device 200 described with respect to FIG. 2 illustrates the compact, planar shape of the waveguide feed network 220 of the waveguide device 200. This structure may enable waveguide-fed horn arrays with reduced grating lobes and a low profile corporate feeding structure that provides wide bandwidth operations. Some of the Figures below describe specific structural examples of possible components of a waveguide device or antenna array.

Figure 3:
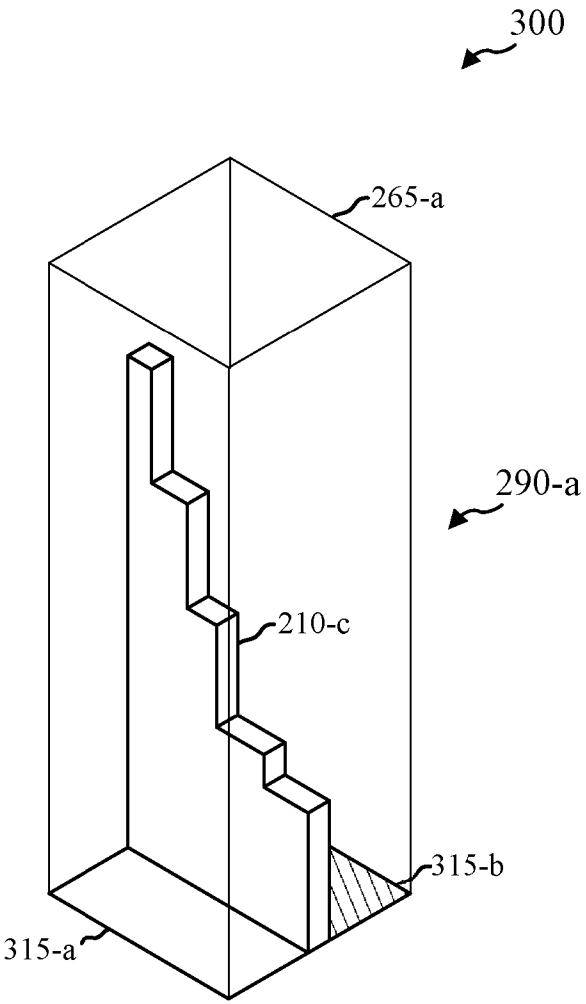
FIG. 3 illustrates a diagram of an element including a septum polarizer and a radiating element in accordance with various embodiments.

FIG. 3 illustrates a diagram 300 of an element 290-*a* including a septum polarizer 210-*c* and a common waveguide port 265-*a* in accordance with various embodiments. The element 290-*a* may also include a first divided waveguide port 315-*a* and a second divided waveguide port 315-*b*. The element 290-*a* may be an example of one or more aspects of the element 290 of FIG. 2. The septum polarizer 210-*c*, the common waveguide port 265-*a*, and the divided waveguide ports 315 may be examples of one or more aspects of the septum polarizer 210, the common waveguide port 265, and the divided waveguide ports 215 of FIG. 2. The element 290-*a* may correspond to one septum polarizer and radiating element in an antenna array, such as the antenna array 140 of FIG. 1. That is, several of the element 290-*a* may be arrayed as an antenna array 140.

The common waveguide port 265-*a* as shown in the example of FIG. 3 is a waveguide aperture that may be a radiating element of an antenna array. A waveguide aperture may be square, as shown in FIG. 3, circular, or any other shape allowing reception and transmission of any desired electromagnetic field polarization. For example, the waveguide aperture may be a common square port. The waveguide aperture may also be loaded with dielectric bodies.

The septum polarizer 210-*c* may be shaped to generate circular polarization at the common waveguide port 265-*a* from linear polarization entering the divided waveguide ports 315. For example, the septum polarizer 210-*c* has a staircase structure that circularly polarizes radiation passing along the septum polarizer 210-*c*. The septum polarizer 210-*c* may be metallic or metal-plated. In some examples, the radiation entering the divided waveguide ports 315 may generate arbitrary polarization at the common waveguide port 265-*a*.

In this example, the element 290-*a* operates in a dual circular polarization mode. In other examples, the septum polarizer 210-*c* may generate other types of polarization, such as linear polarization. The element 290-*a* may be able to be used in a dual linear polarization mode. For the dual linear polarization mode, the element 290-*a* would generate two orthogonal linear polarizations at the radiating element 205-*a* by using a polarization duplexer (e.g., orthomode transducer, etc.) exhibiting a similar topology as the septum polarizer 210-*c* with a polarization duplexing waveguide structure and two separate ports in a similar geometrical configuration. In general, the techniques and systems described herein may apply to any system using polarization duplexers in which two divided waveguide ports are in a similar geometrical configuration as in FIG. 3, that is, in which they are separated at a plane towards an end of the element 290-*a*.

For radiation received at the common waveguide port 265-*a*, the septum polarizer 210-*c* divides the incoming radiation according to polarization. A circularly polarized wave having the first polarization entering the common waveguide port 265-*a* may be translated to a linearly polarized signal at the first divided waveguide port 315-*a*. A circularly polarized wave having the second polarization entering the common waveguide port 265-*a* may be translated to a linearly polarized signal at the second divided waveguide port 315-*b*. In some instances, the element 290-*a* may operate in a transmission mode for a first polarization (e.g., LHCP) while operating in a reception mode for a second polarization (e.g., RHCP).

One example size for the element 290-*a* is as follows, although other dimensions may be used. The cross section of the common waveguide port 265-*a* may be 9 millimeters (mm) by 9 mm, for example. Each divided waveguide port 315 may be 9 mm by 4 mm. The thickness of the septum polarizer 210-*c* may be 1 mm and the height may be 16 mm.

The size of various components of the element 290-*a* may be selected based on a desired frequency bandwidth.

Figure 4:
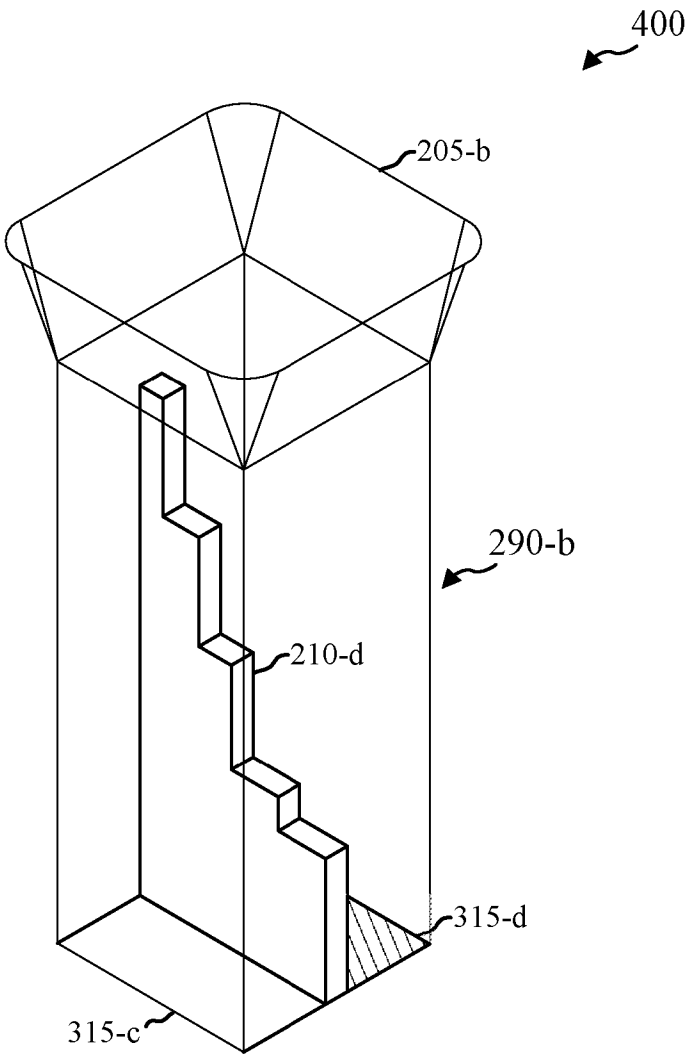
FIG. 4 illustrates a diagram of another element including a septum polarizer and radiating element in accordance with various embodiments.

FIG. 4 illustrates a diagram 400 of another element 290-*b* including a septum polarizer 210-*d* and radiating element 205-*b* in accordance with various embodiments. The element 290-*b* also includes divided waveguide ports 315-*c* and 315-*d*. The element 290-*b* may correspond to one septum polarizer and radiating element in an antenna array, such as the antenna array 140 of FIG. 1. The septum polarizer 210-*d* and the divided waveguide ports 315 may be examples of one or more aspects of the septum polarizer 210 and the divided waveguide ports 215, 315 of FIGS. 2 and 3. These components may have similar functionality as the corresponding components in FIGS. 2 and 3 and are not described again for brevity.

The radiating element 205-*b* of FIG. 4 is a horn radiating element. The radiating element 205-*b* may be square horn element. In other examples, the radiating element 205-*b* may be circular or have another shape that allows reception and transmission of any desired polarization of the electromagnetic field. In some examples, the horn height may be about 5 mm and the size of the top aperture may be 12.5 by 12.5 mm.

Figure 5:
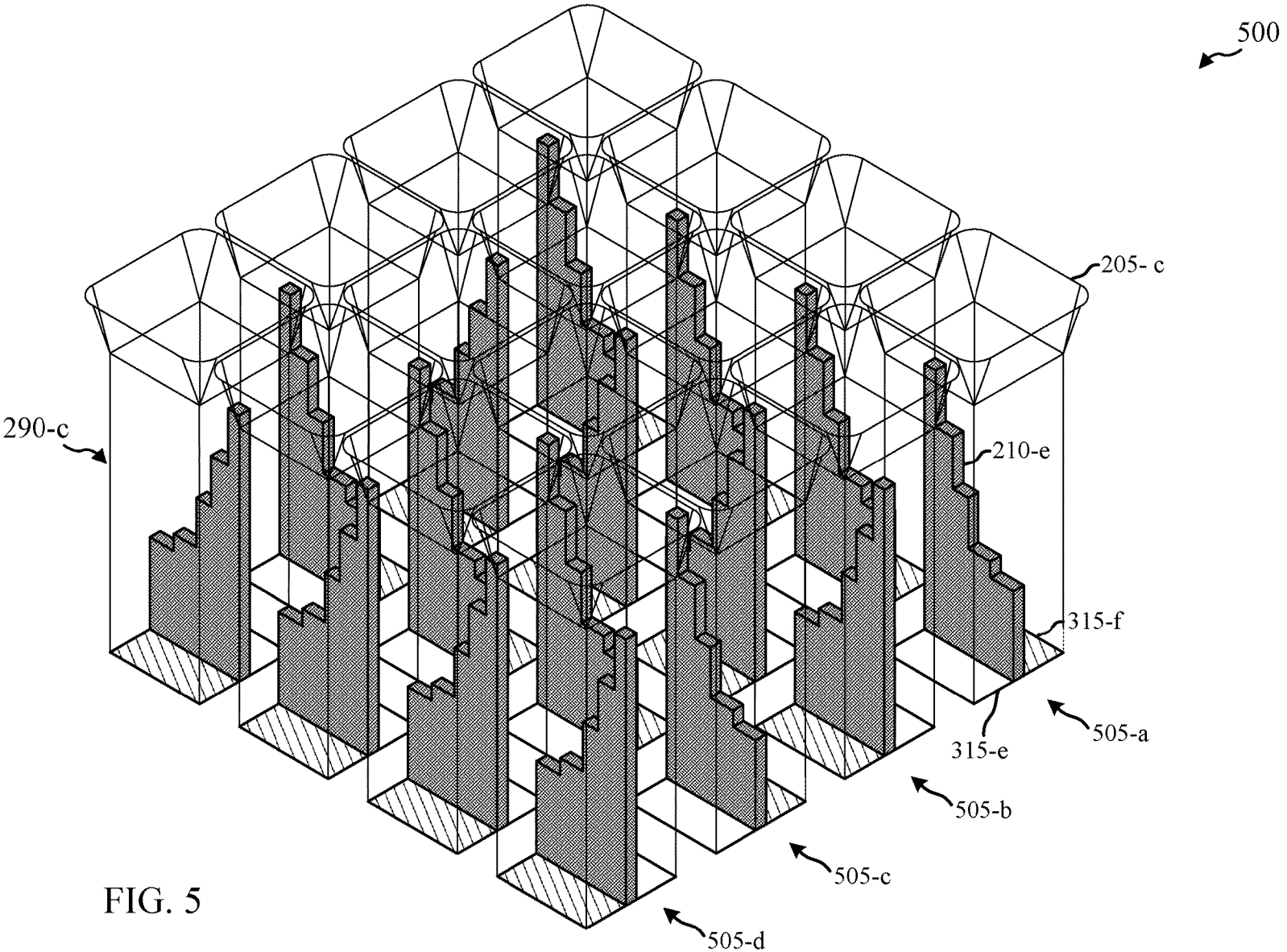
FIG. 5 shows a perspective view of a portion of a waveguide device in accordance with various embodiments.

FIG. 5 shows a perspective view of a diagram of a sub-array 500 of a waveguide device in accordance with various embodiments. The sub-array 500 includes a four-by-four array of antenna elements 290-*c*. The sub-array 500 may make up a part of a waveguide device, which may be part of a periodic antenna array. Some example periodic antenna arrays include several sub-arrays 500. The sub-array 500 may be a part of an example of the dual polarized planar horn antenna array 140 of FIG. 1. The sub-array 500 may illustrate a portion of a waveguide device 200 of FIG. 2.

The sub-array 500 includes sixteen antenna elements 290-*c*, which include sixteen septum polarizers, divided waveguide ports, and radiating elements. For clarity, only one of each radiating element 205-*c*, septum polarizer 210-*e*, and divided waveguide ports 315 is labeled in FIG. 5. The divided waveguide port 315-*e* may be associated with a first polarization and the divided waveguide port 315-*f* may be associated with a second polarization. The radiating element 205-*c*, the septum polarizer 210-*e*, and the divided waveguide ports 315 may be examples of one or more aspects of the radiating element 205, the septum polarizer 210, and the divided waveguide ports 215, 315 of FIGS. 2-4. These components may have similar functionality as the corresponding components in FIGS. 2-4, which is not repeated here for brevity.

In one example, the inter-element distance between the center of each element 290-*c* may be approximately 13 mm. In other examples, other inter-element distances may be used based on a desired operational frequency range. The dimensions of the sub-array 500 may be representative of an example where the inter-element distance is sufficiently small to avoid most grating lobes and the waveguides are sufficiently wide to support propagation at all frequencies of interest.

The sub-array 500 of the periodic antenna array may include four rows 505-*a*, 505-*b*, 505-*c*, and 505-*d* (collectively referred to herein as "rows 505"). The rows 505 may have septum polarizers in alternating orientations. That is, the septum polarizers 210-*e* in rows 505-*a* and 505-*c* (making up a first group of septum polarizers) have a first orientation. The septum polarizers 210-*e* in rows 505-*b* and 505-*d* (making up a second group of septum polarizers) have a second orientation, inverted relative to the septum polarizers 210-*e* in rows 505-*a* and 505-*c*. The first orientation may be rotated approximately 180° (degrees) from the second orientation. That is, the septum polarizers 210-*e* of one row over two have been flipped. In this way, the divided waveguide ports 315-*e* may be adjacent to each other in adjacent rows and the divided waveguide ports 315-*f* may be adjacent to each other in adjacent rows. Because the divided waveguide ports 315 associated with the same polarization type are adjacent to each other at the bottom of the sub-array 500, the divided waveguides may be grouped for coupling with a waveguide feed structure. Grouping of adjacent units of the divided waveguides 215-*c* is further illustrated in FIG. 6.

Figure 6:
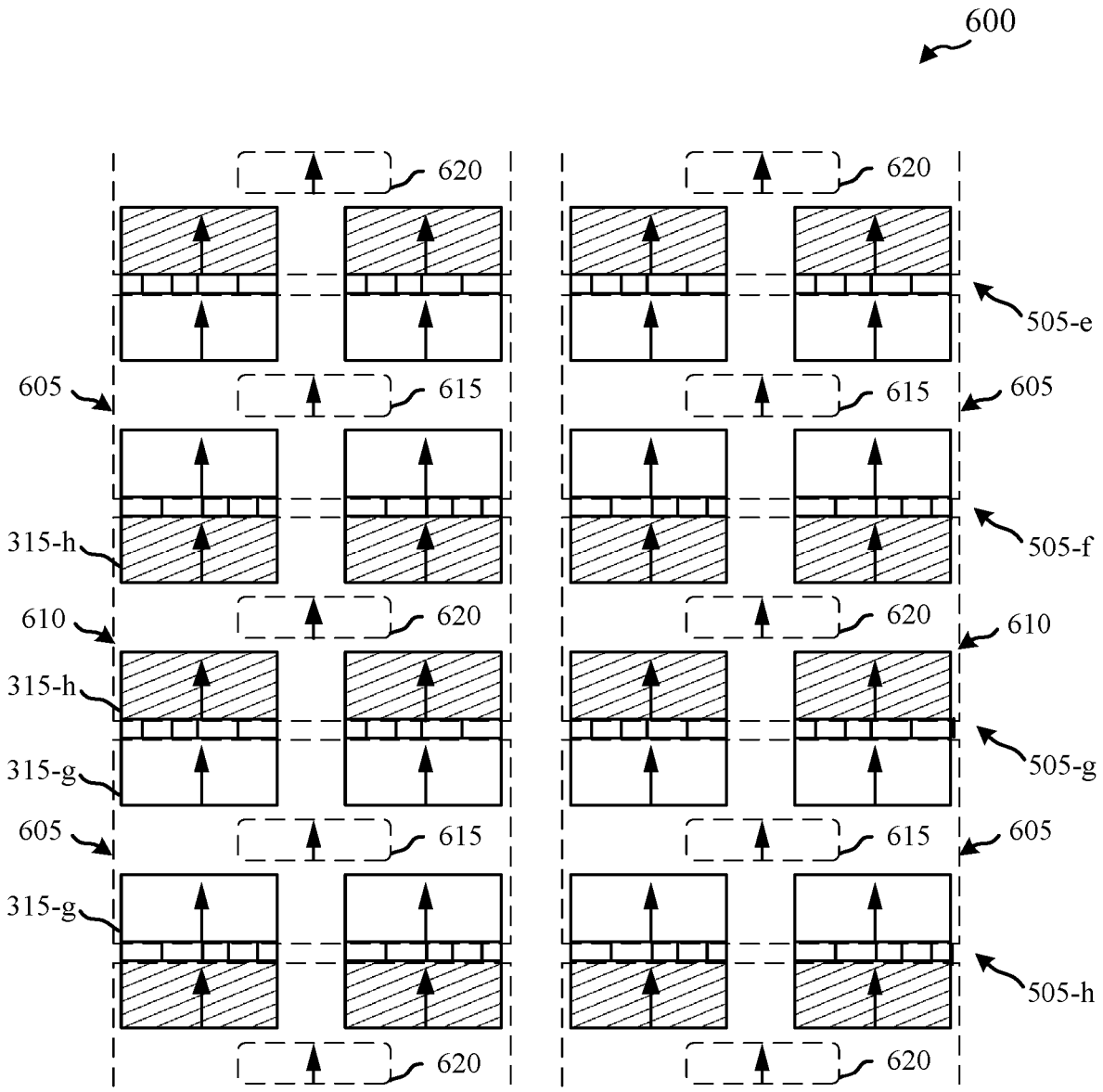
FIG. 6 shows a view of a feed network interface for a sub-array of a waveguide device in accordance with various embodiments.

FIG. 6 shows a view 600 of a feed network interface for a sub-array of a waveguide device in accordance with various embodiments. The view 600 may illustrate or more aspects of an example of the sub-array 500 of FIG. 5. The view 600 illustrates a feed network interface for a four-by-four (4×4) array of waveguide elements.

The view 600 illustrates rows 505-*e*, 505-*f*, 505-*g*, and 505-*h*, which may correspond to rows 505-*a*, 505-*b*, 505-*c*, and 505-*d* of FIG. 5. The rows 505-*e* through 505-*h* may include alternating septum polarizers as discussed above. Four adjacent divided waveguides 315-*g* (such as divided waveguides 215, 315 of FIGS. 2-5) may be grouped together into a 4×4 block 605. That is, the block 605 includes first groups of four adjacent divided waveguides associated with a first polarization. The sub-array 600 includes four interface blocks 605 associated with the first polarization. Each interface block 605 may illustrate the waveguide coupling between a first common port 615 of a first combiner/divider, such as a combiner/divider 225 of FIG. 2. The first common ports 615 may also be referred to as right-hand module ports.

Likewise, four adjacent divided waveguides 315-*h* may be grouped together into a 4×4 interface block 610. That is, the interface block 610 includes second groups of four adjacent divided waveguides 315-*h*. The sub-array 600 includes two complete blocks 610 associated with the second polarization. Four incomplete interface blocks 610 including only two divided waveguides 315-*h* are illustrated in FIG. 6. However, depending on the size of the antenna array, additional rows may be included above and below the sub-array 600. Connecting each interface block 610 may be a second common port 620 of a second combiner/divider, such as a combiner/divider 230 of FIG. 2. The second common port 620 may also be referred to as left-hand module ports.

In other words, a first stage of a feed network may combine the divided waveguide ports 315 associated with the same polarization by groups of 2×2. These 1-to-4 feed modules are represented in the interface blocks 605 and 610 of FIG. 6, with their common port (e.g., the common ports 615, 620) in the center. In another example, the feed modules may be implemented by a succession of H-plane (e.g., in the magnetic field direction) and E-plane (e.g., in the electric field direction) T-junctions, for instance, or the same in the reverse order. They may also be implemented by a cavity-based structure with one port at the bottom and four ports at the top.

Grouping the divided waveguides 315 by polarization type in this way allows for the combiner/dividers to be sufficiently distant from each other such that their combination with planar corporate rectangular waveguide feed networks can be achieved. Purely corporate feed networks may be preferred for their broadband properties, but series or hybrid series/corporate networks may be used, in some examples.

Figure 7:
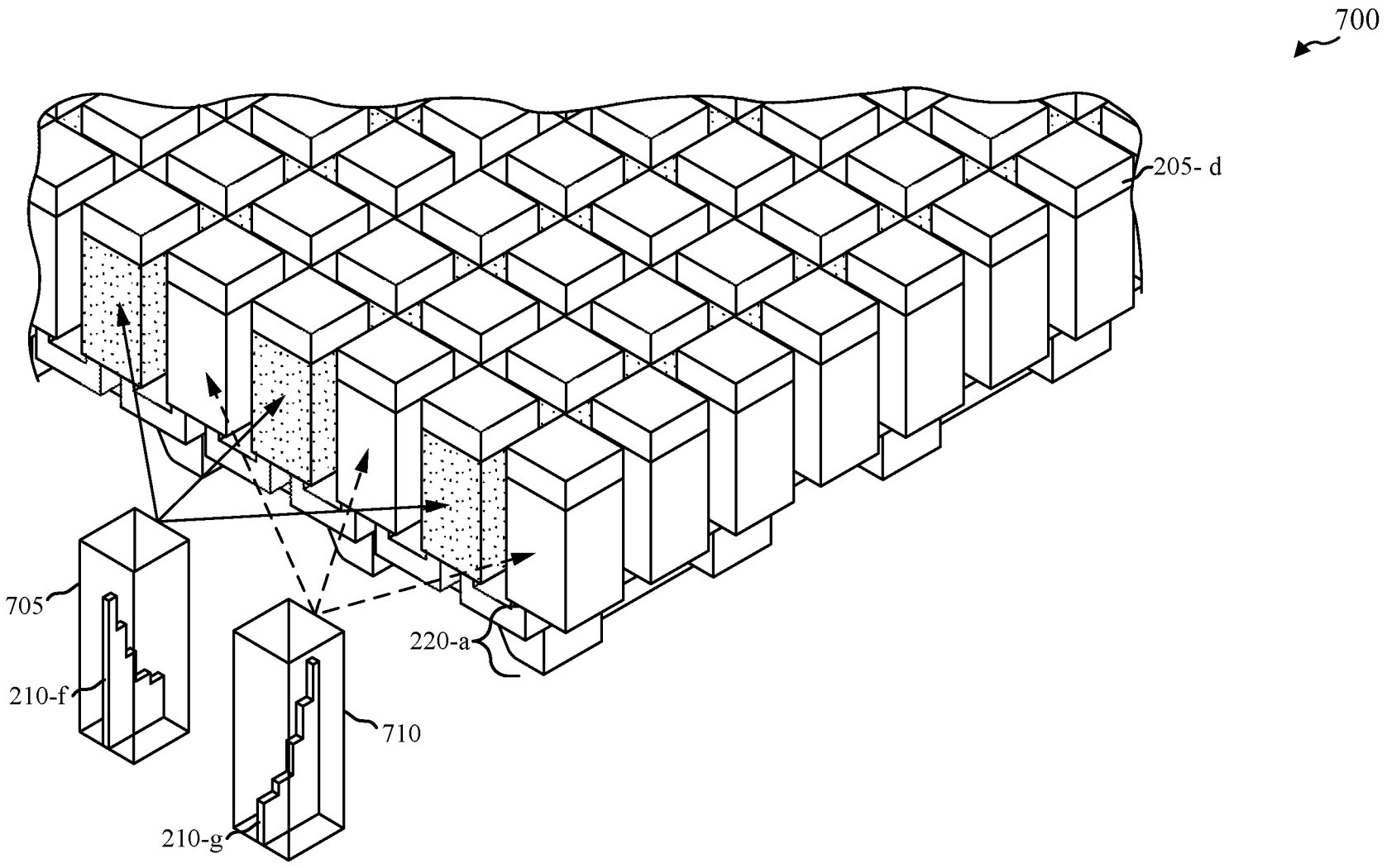
FIG. 7 shows a perspective view of a portion of a waveguide device in accordance with various embodiments.

FIG. 7 shows a perspective view of a diagram of a sub-array 700 of a waveguide device in accordance with various embodiments. The sub-array 700 may be an example of one or more aspects of the portions 500 and 600 of FIGS. 5 and 6, respectively, or the waveguide device 200 of FIG. 2. The sub-array 700 may make up a part of a periodic antenna array. The periodic antenna array may be an example of the dual polarized planar horn antenna array 140 of FIG. 1. For simplicity and clarity, only one of each repeated element is labeled in FIG. 7.

The sub-array 700 of the waveguide device includes multiple first antenna elements 705 and second antenna elements 710. The antenna elements 705, 710 may be an example of one or more aspects of the antenna elements 290 of FIGS. 2-4. The antenna elements 705, 710 may be arranged in alternating rows, as illustrated by the lines from the antenna elements 705, 710 to their respective rows in FIG. 7. The first antenna elements 705 may include a septum polarizer 210-*f* oriented in a first direction. The second antenna elements 710 may include a septum polarizer 210-*g* oriented in a second direction, inverted or flipped with respect to the first direction. A radiating element 205-*d* may be affixed to each antenna element 705, 710.

Also illustrated in FIG. 7 is a waveguide feed network 220-*a*. The waveguide feed network 220-*a* may be an example of one or more aspects of the waveguide feed network 220 of FIG. 2. The waveguide feed network 220-*a* may include a 1-to-4 feed module coupled between divided waveguide ports of the waveguide elements 705, 710 having the same polarization and intermediate waveguides, as well as a second waveguide feed stage. Examples of the waveguide feed network 220-*a* and the second waveguide feed stage are further described in FIGS. 8A-8E, 9, 10A, 10B, 11A, 11B, 12A, and 12B.

FIGS. 8A-8E show views of a waveguide device sub-array 200-*a* in accordance with various embodiments. The waveguide device sub-array 200-*a* may be an example of the waveguide device 200 of FIG. 2. The waveguide device sub-array 200-*a* may be used in an antenna array, such as the dual polarized planar horn antenna array 140 of FIG. 1. For simplicity and clarity, only one of each repeated element is labeled in FIG. 8A.

Figure 8A:
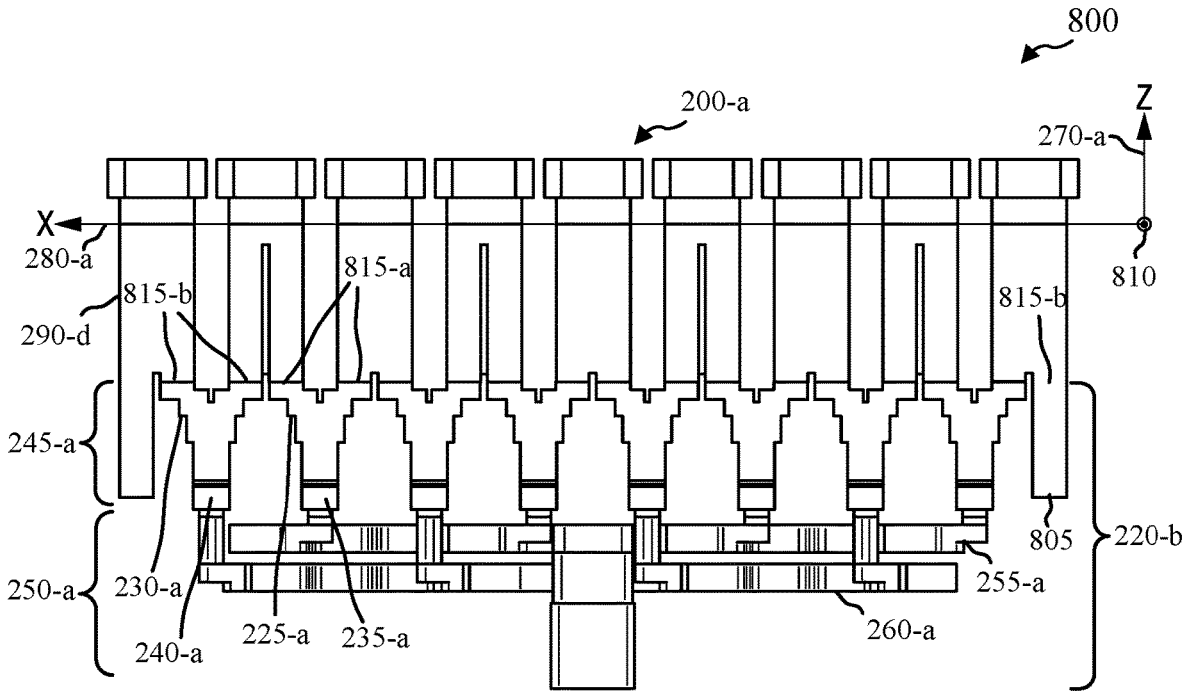
FIGS. 8A-8E show various views of a waveguide device in accordance with various embodiments.

FIG. 8A shows a side view 800 of the waveguide device sub-array 200-*a*. The waveguide device sub-array 200-*a* may include a set of antenna elements 290-*d*, which may be examples of one or more aspects of antenna elements 290, 705, and 710 of FIGS. 2-4 and 7. The antenna elements 290-*d* may have a waveguide propagation direction substantially oriented along the z-axis 270-*a*. Each antenna element 290-*d* may have a first divided waveguide port 815-*a* and a second divided waveguide port 815-*b*. The first divided waveguide ports 815-*a* may be associated with signals having a first polarization (e.g., LHCP) in the antenna element 290-*d* while the second divided waveguide ports may be associated with signals having a second polarization (e.g., RHCP) in the antenna element 290-*d*. Because alternating rows of antenna elements 290-*d* are rotated 180° from one another about z-axis 270-*a*, the first divided waveguide ports 815-*a* from adjacent rows are adjacent to one another along x-axis 280-*a*. Some antenna elements 290-*d* that are on the outside of the array of the waveguide device sub-array 220-*a*, such as element 805, may have divided waveguide ports that are terminated. For example, a divided waveguide port 815-*b* may be terminated using the waveguide element 805 that is not connected to waveguide feed network 220-*b*.

The waveguide feed network 220-*b* may be an example of one or more waveguide feed networks 220 of FIGS. 2 and 7. The waveguide feed network 220-*b* includes a first waveguide feed stage 245-*a* and a second waveguide feed stage 250-*a*. The first waveguide feed stage 245-*a* includes, in alternating rows, a first set of combiner/dividers 225-*a* and a second set of combiner/dividers 230-*a*. Each of the first set of combiner/dividers 225-*a* is coupled between a group of divided waveguide ports 815-*a* associated with the first polarization and one of a set of first intermediate waveguides 235-*a*. Each of the first intermediate waveguide 235-*a* is coupled with a first feed network 255-*a*. Each of the second set of combiner/dividers 230-*a* is coupled between a group of divided waveguide ports 815-*b* associated with the second polarization and one of a set of second intermediate waveguides 240-*a*. Each of the second intermediate waveguides 240-*a* is coupled with a second feed network 260-*a*. The first and second feed networks 255-*a* and 260-*a* may be coupled with the first intermediate waveguides 235-*a* and 240-*a*, respectively, through transition sections such as an E-plane bend. The components 220-*b*, 245-*a*, 250-*a*, 225-*a*, 230-*a*, 235-*a*, 240-*a*, 255-*a*, and 260-*a* may have similar functionality as the correspondingly numbered components in FIGS. 2, 6, and 7 and are not described again in the interest of brevity.

The first waveguide feed stage 245-*a* may include multiple 1-4 feed modules. In other examples, other ratios of feed modules may be used. For example, a feed module may be 1-2, 1-6, 1-8, or 1-10, depending on how many adjacent divided waveguides are combined.

The first feed network 255-*a* may be located substantially in a plane between the intermediate waveguides 235, 240 and the second feed network 260-*a*. The first feed network 255-*a* and the second feed network 260-*a* each have a waveguide propagation direction substantially orthogonal to the z-axis 270-*a* (e.g., within the plane defined by the x-axis 280-*a* and the y-axis 810). Thus, the first feed network 255-*a* and the second feed network 260-*a* may be planar corporate type waveguide feed networks having a low profile in the z-axis.

The waveguide device sub-array 200-*a* illustrates how a first waveguide feed stage for a polarization may extend in a direction perpendicular to the directions in which the second waveguide feed stage extends. For example, the first waveguide feed stage 245-*a* generally extends in the z-axis 270-*a*, while the second waveguide feed stage 250-*a* extends in a plane parallel to the plane created by the x-axis 280-*a* and y-axis 810.

Figure 8B:
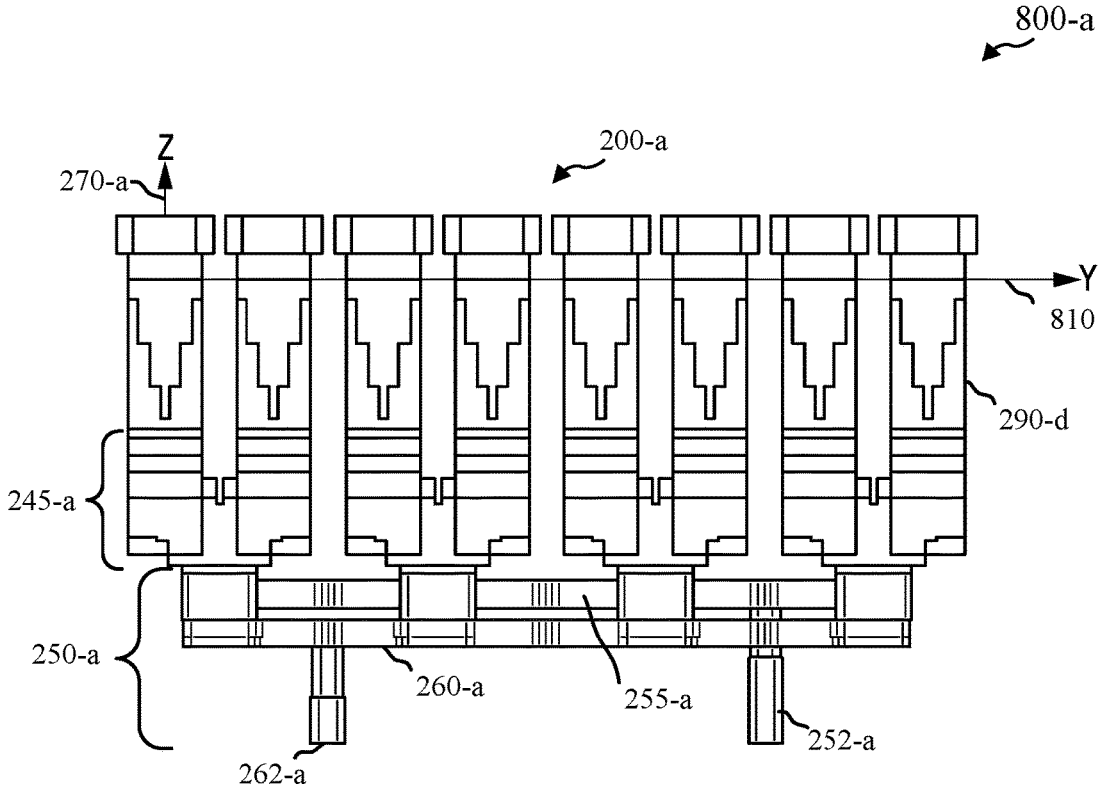

FIG. 8B shows another side view 800-*a* of waveguide device 200-*a*. In side view 800-*a*, the waveguide device sub-array 200-*a* is rotated approximately 90° from side view 800 of FIG. 8A. Side view 800-*a* illustrates device port 252-*a* coupled with the first feed network 255-*a* and device port 262-*a* coupled with the second feed network 260-*a*.

Figure 8C:
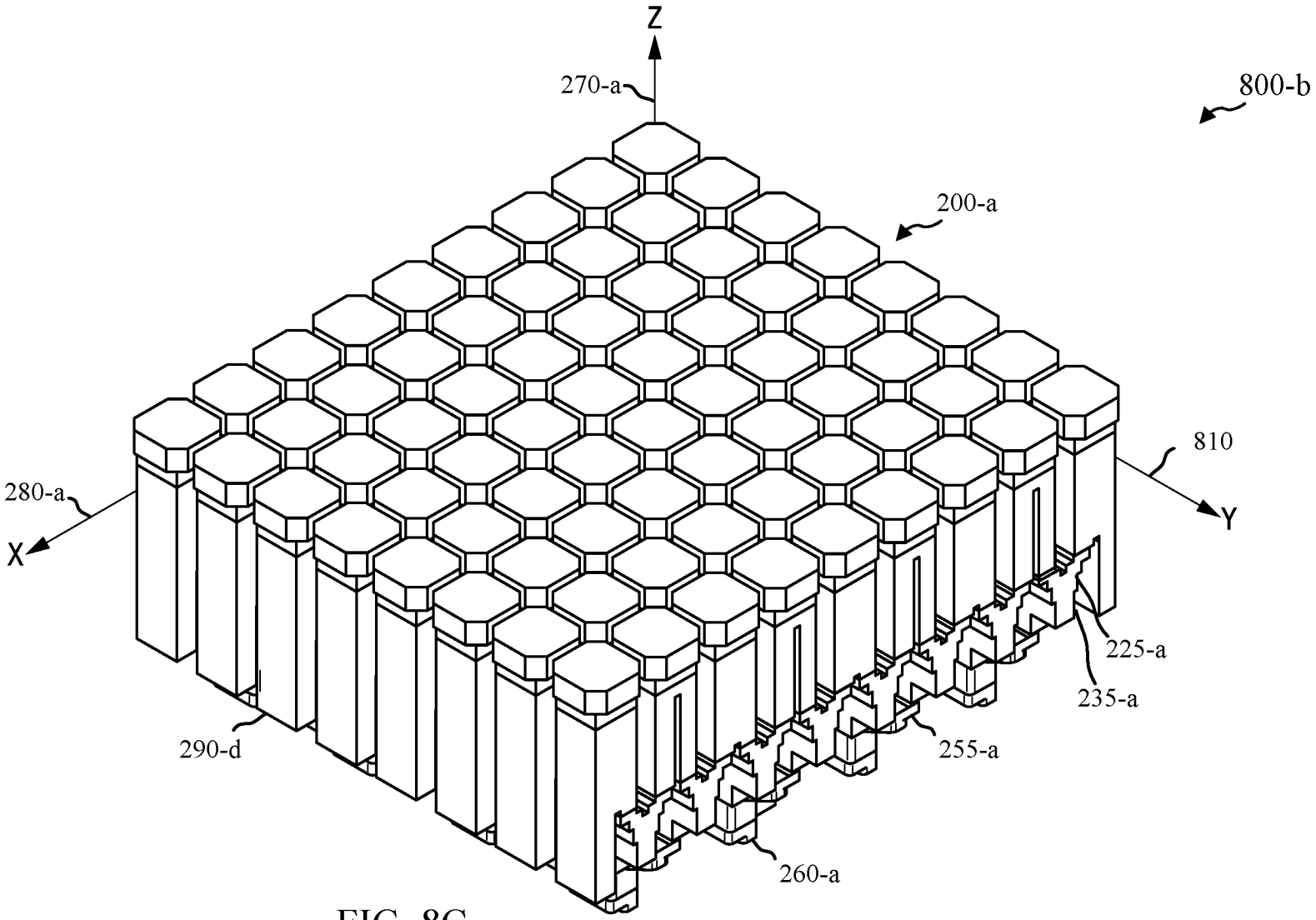

FIG. 8C shows an isometric view 800-*b* of the waveguide device 200-*a*. The waveguide device 200-*a*, shown more readily in FIG. 8C, is an 8×8 array (8×9 elements with half of the divided waveguide ports of the outside elements terminated). Some antenna elements 290-*d* on the outside edge of the array of the waveguide device 200-*a* may have terminated divided waveguide ports. Waveguide device 200-*a* may be extended by adding other portions to the waveguide device 200-*a*.

Figure 8D:
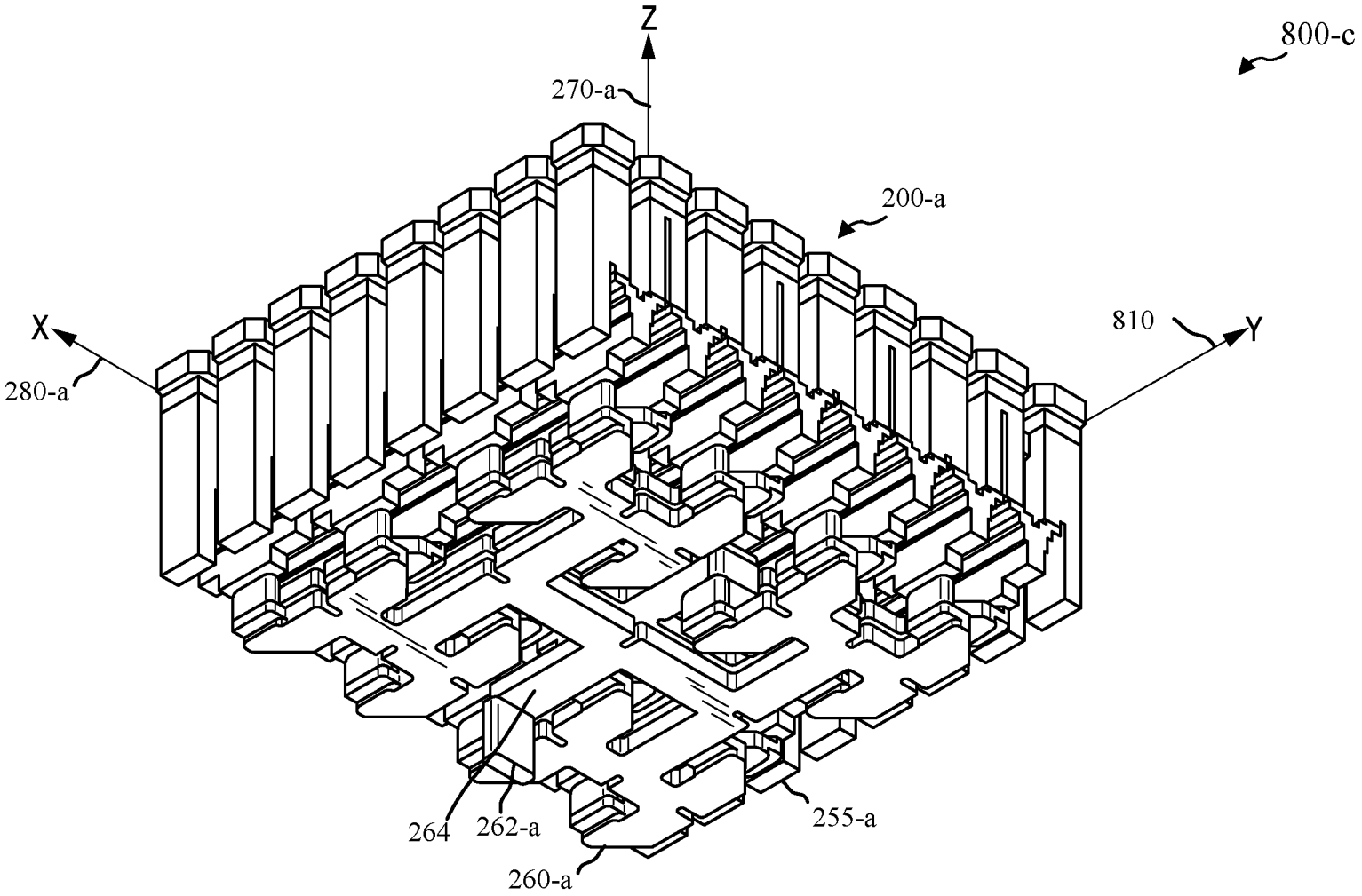

FIG. 8D shows another isometric view 800-*c* of the waveguide device 200-*a*. As discussed above, multiple waveguide devices 200-*a* may be connected to make a larger array of antenna elements 290-*d*. For example, a feed waveguide 264 of the second feed network 260-*a* may be coupled with another feed waveguide 264 of an adjacent 8×8 waveguide device sub-array via a junction (e.g., H-plane tee, etc.). In some instances, a 2×2 array of waveguide device sub-arrays 200-*a* (e.g., 16×16 antenna elements 290) may be provided using waveguide device sub-array 200-*a* without additional feed network layers. That is, the first feed network 255-*a* and second feed network 260-*a* may be extended to connect four waveguide device sub-arrays 200-*a* in a corporate waveguide feed structure within the same waveguide planes illustrated in FIGS. 8A-8E. In addition, multiple arrays of 16×16 antenna elements may be further arrayed using additional corporate feed structures in additional layers. The waveguide device sub-array 200-*a* illustrates how the second feed network 260-*a* may be on the outside of the waveguide device 200-*a* and adjacent to the first feed network 255-*a*.

Figure 8E:
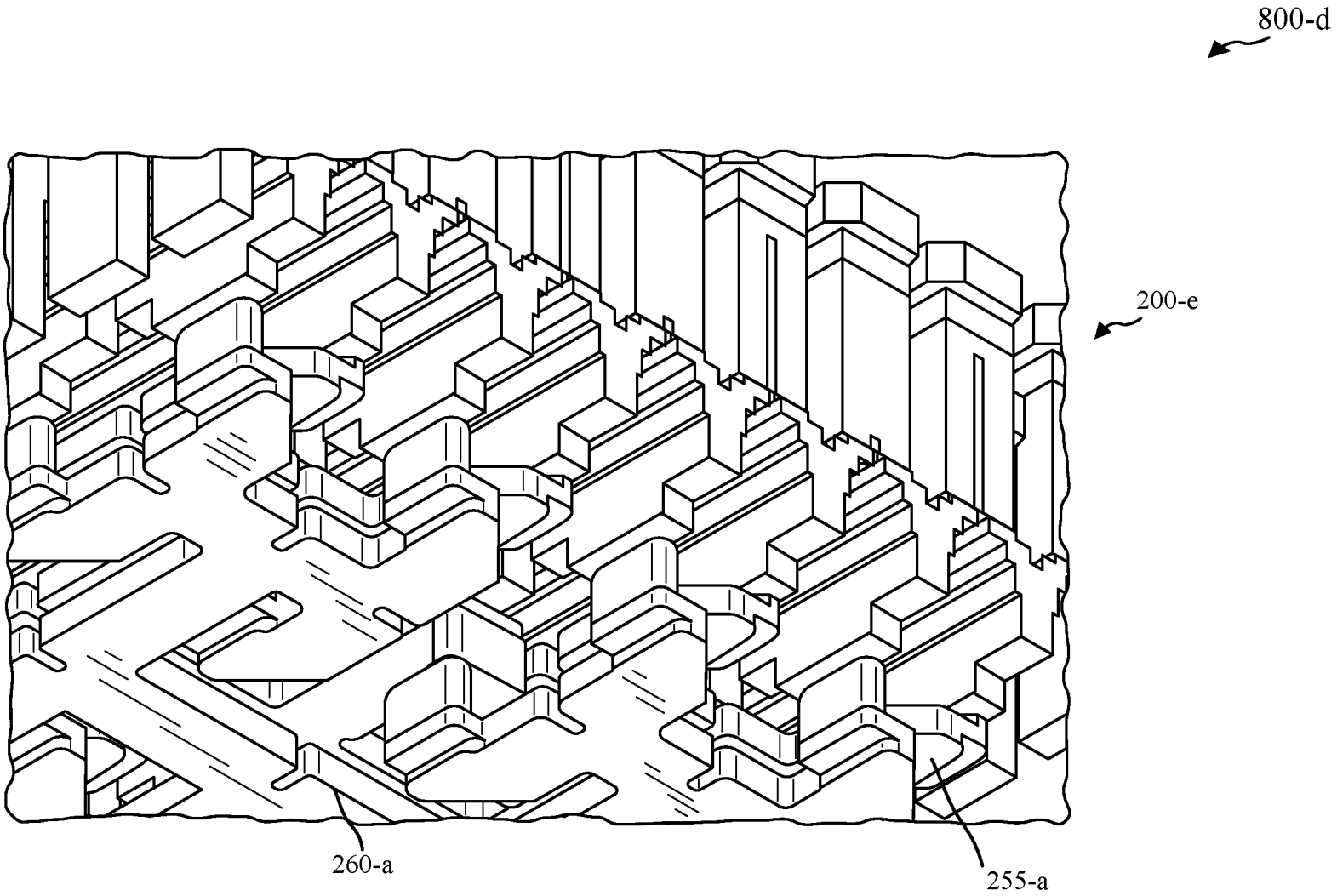

FIG. 8E shows another isometric view 800-*d* of a portion of the waveguide device 200-*a*. View 800-*d* illustrates the example waveguide structure for the first feed network 255-*a* and second feed network 260-*a* in more detail.

Figure 9:
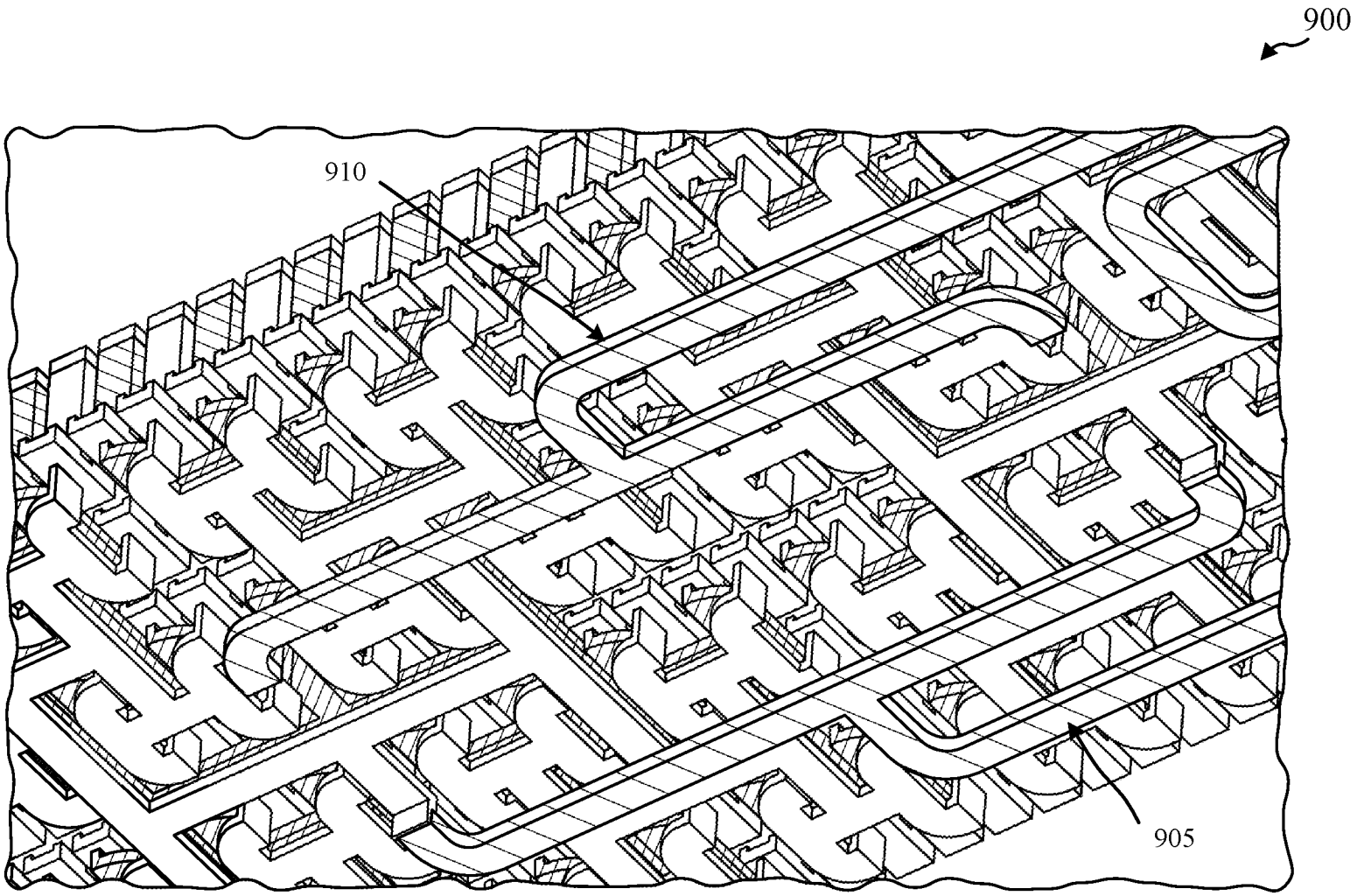
FIG. 9 shows an isometric view of a larger portion of a waveguide device in accordance with various embodiments.

FIG. 9 shows an isometric view of a waveguide device 900 in accordance with various embodiments. The waveguide device 900 may be an extended antenna array. That is, waveguide device 900 may include many antenna elements, such as 1280 elements (the waveguide device 900 may be a 80×16 array, for example). The waveguide device 900 may be an example of the waveguide device 200 of FIGS. 2 and 8A-8E. The waveguide device 900 may be used in an antenna array, such as the dual polarized planar horn antenna array 140 of FIG. 1. The waveguide device 900 may have similar components to the antenna arrays 140 and waveguide device 200, and is not described again in the interest of brevity.

The waveguide device 900 may include multiple waveguide devices 200 such as the waveguide devices 200 of FIGS. 2 and 8A-8E or sub-array 700 of FIG. 7. As discussed above, the first feed network 255 and the second feed network 260 for multiple waveguide devices 200 may be coupled with junctions in the same waveguide plane (e.g., H-plane tee junctions, etc.). Thus, the corporate feed networks can be straightforwardly extended for antenna arrays with large numbers of elements. In the example of FIG. 9, the waveguide device 900 may include a third feed network 905 that is coupled with the first feed networks and a fourth feed network 910 that is coupled with the second feed networks for multiple waveguide device sub-arrays 200-*a*.

Figure 10A:
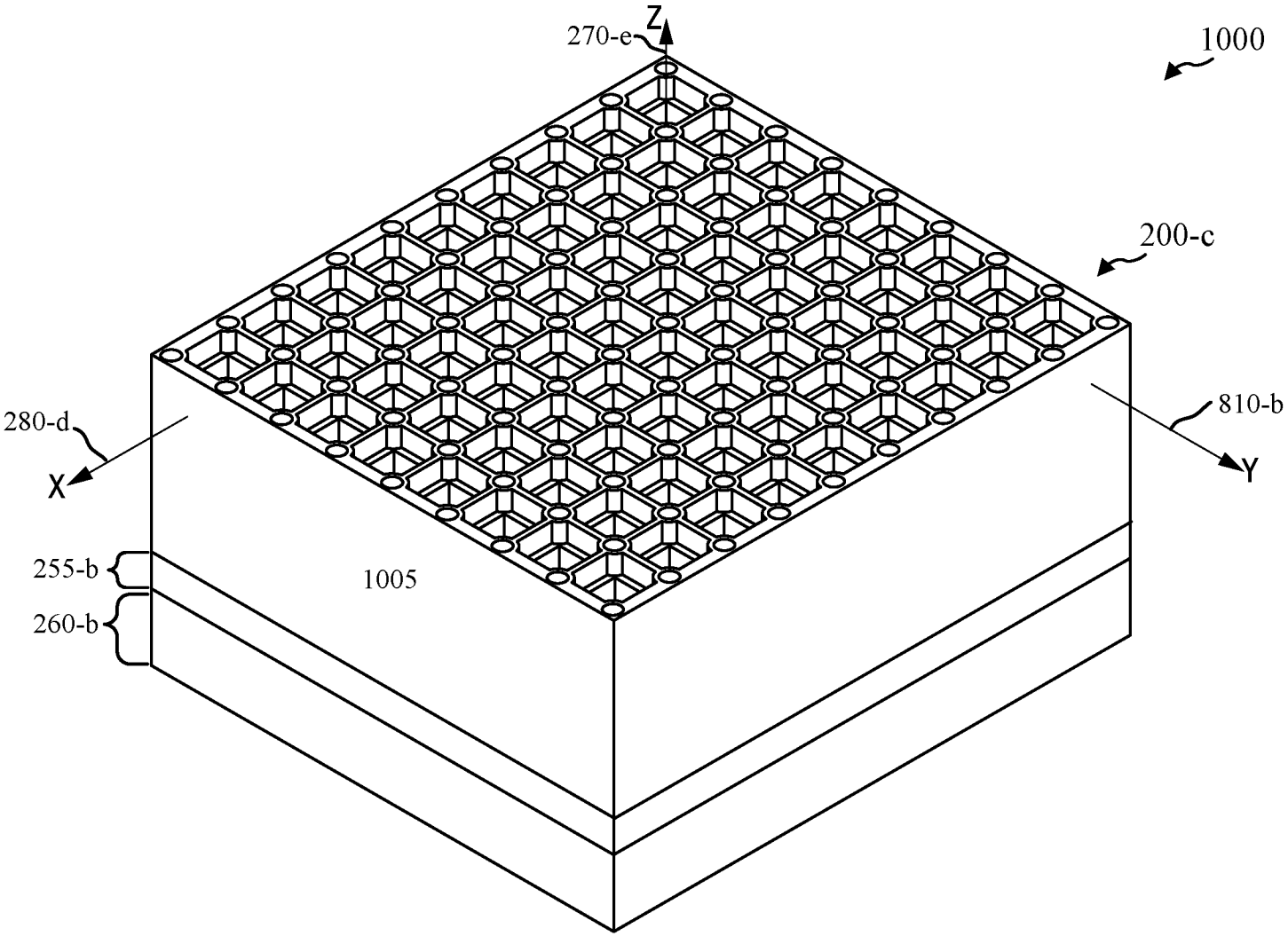
FIGS. 10A and 10B show views of a waveguide device in accordance with various embodiments.
Figure 10B:
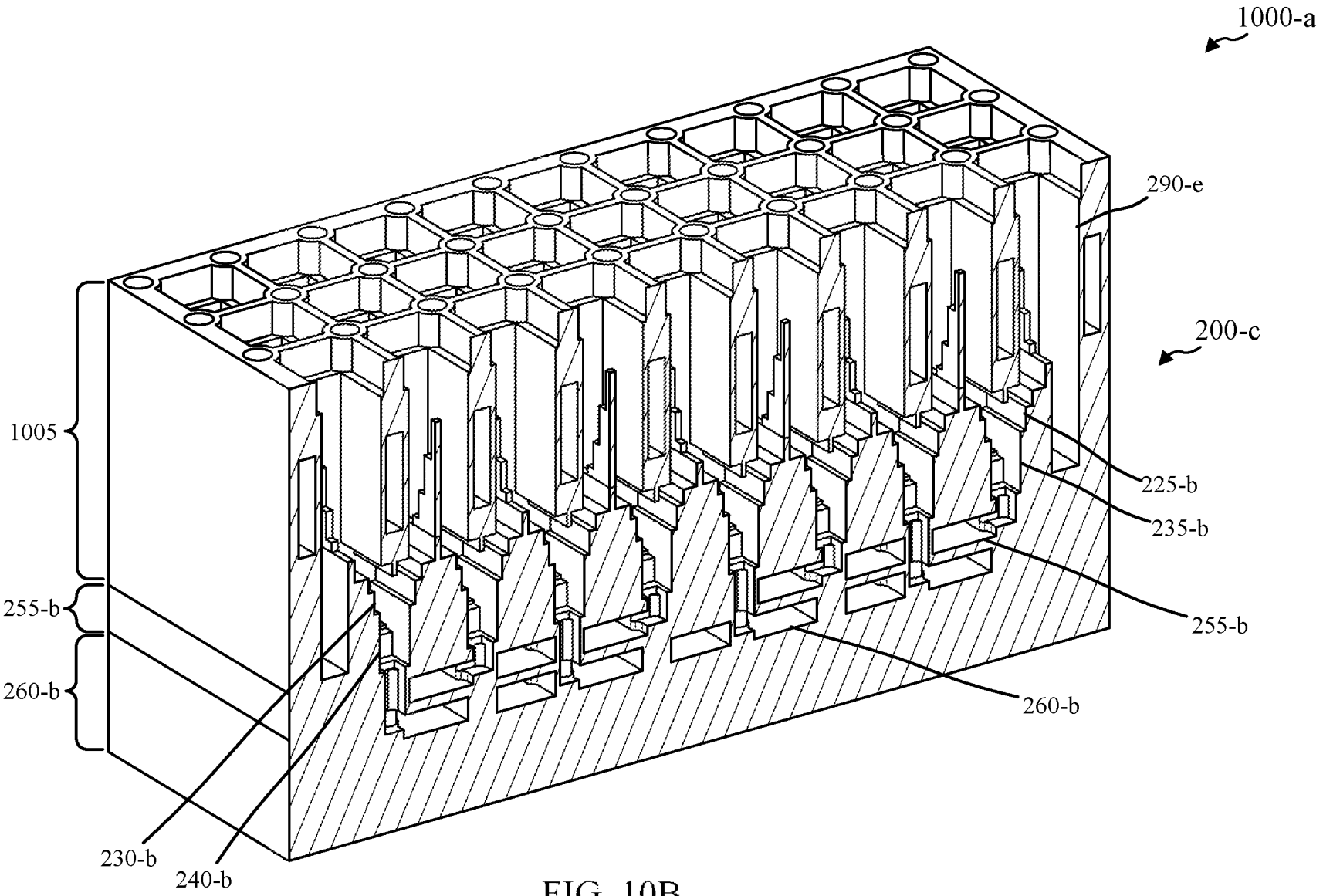

Turning now to FIGS. 10A and 10B, views of a waveguide device 200-*c* are shown in accordance with various embodiments. FIG. 10A shows an isometric view 1000 of waveguide device 200-*c*. The waveguide device 200-*c* may be an example of the waveguide device 200 of FIGS. 2 and 8A-8E, and waveguide device 900 of FIG. 9. The waveguide device 200-*c* may be used in an antenna array, such as the dual polarized planar horn antenna array 140 of FIG. 1. The waveguide device 200-*c* may have similar components to the antenna arrays 140 and waveguide device 200, and is not described again in the interest of brevity.

The waveguide device 200-*c* includes a section 1005 that includes a set of antenna elements 290 and a first waveguide feed stage 245. The section 1005 may be formed as an integral component. The section 1005 may form the antenna elements 290, the combiner/dividers 225 and 230, and the intermediate waveguides 235 and 240. That is, these waveguide components may be formed in a single integral section 1005 of waveguide device 200-*c*.

The section 1005 may be formed using three dimensional (3D) printing. The section 1005 may be printed using any suitable material, such as metal, plastic, or ceramics. In examples where the section 1005 is not made from metal, the section 1005 may be metal plated. The structure of the section 1005 described herein (e.g., the intermediate waveguides 235 and 240 having a waveguide propagation direction that is substantially parallel to the antenna elements 290, etc.) make metal plating after 3D printing a reasonable and cost-effective possibility. Metal plating is a reasonable option for these designs because there are few features that would hinder or restrict access of the metal to the surfaces of the section 1005.

The waveguide device 200-*c* further includes a first feed network 255-*b* and a second feed network 260-*b*. The first feed network 255-*b* and the second feed network 260-*b* may be formed as machined sub-assembly layers. However, in some examples, the first and second feed networks 255-*b*, 260-*b* are also 3D printed.

In alternative embodiments, array lattices other than square may be implemented. For example, skewed array lattices may be obtained by shifting each row with respect to the previous one by a fixed fraction of the inter-element distance in a row. For this shape of antenna array 140, the design of the 1-to-4 feed modules may be slightly altered to accommodate the new shape while the rest of the antenna array 140 remains similar.

FIG. 10B shows a cross-sectional view 1000-*a* of waveguide device 200-*c*. The cross-sectional view 1000-*a* illustrates that alternating rows of antenna elements have divided waveguide ports that are grouped for connection with combiner/dividers 225-*b* and 230-*b*, which feed alternating rows of intermediate waveguides 235-*b* and 240-*b*. The cross-sectional view 1000-*a* shows the section 1005 and the first feed network 255-*b* and the second feed network 260-*b*.

Figure 11A:
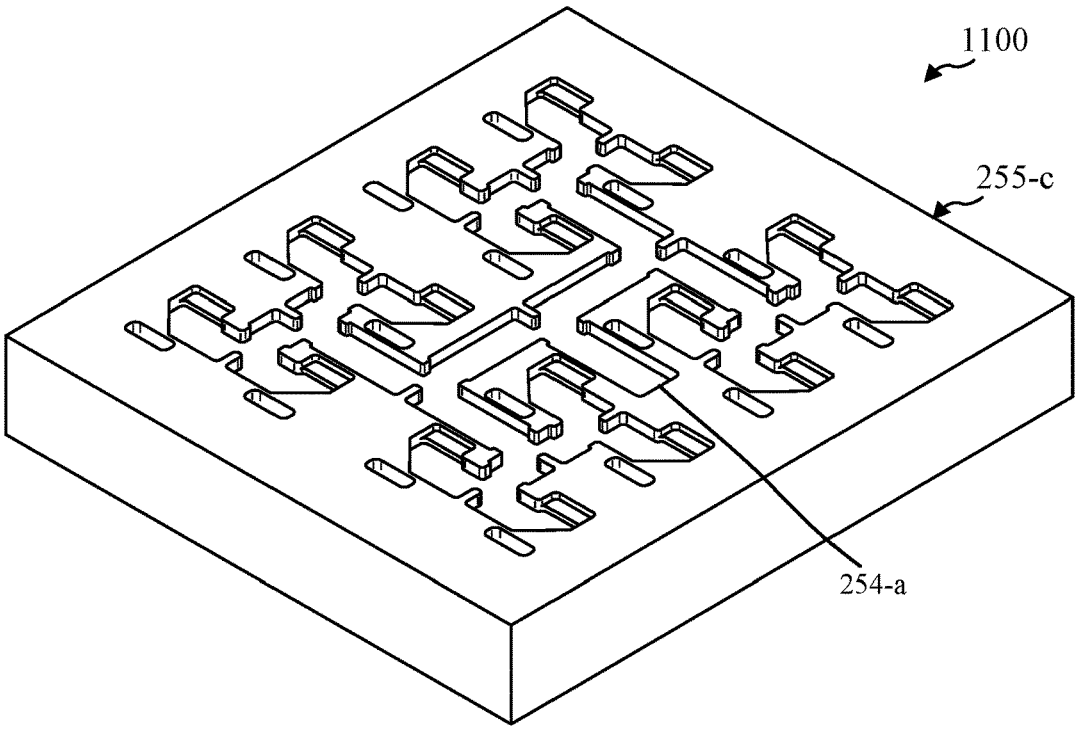
FIGS. 11A and 11B show views of a first feed network in accordance with various embodiments.
Figure 11B:
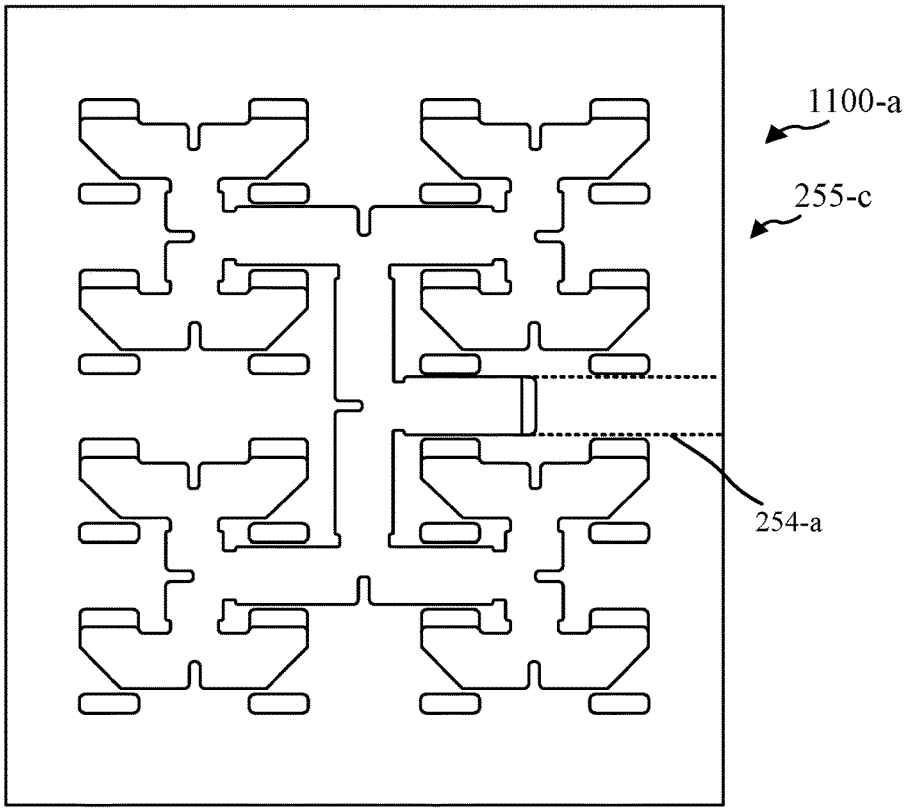

FIGS. 11A and 11B show a first feed network 255-*c* in accordance with various embodiments. The first feed network 255-*c* may be an example of the first feed network 255 of FIGS. 2, 8A-8E, 10A, and 10B. The first feed network 255-*c* may be used in an antenna array, such as the dual polarized planar horn antenna array 140 of FIG. 1.

FIG. 11A shows an isometric view 1100 of the first feed network 255-*c*. The first feed network 255-*c* may be a machined sub-assembly that has machined recesses forming planar waveguides (e.g., H-plane tees, etc.) that couples with the intermediate waveguides 235 for a waveguide device sub-array. For example, the first feed network 255-*c* may be affixed to a section 1005 of the waveguide device 200-*c*. The first feed network 255-*c* may be a corporate type feed network and have waveguide propagation substantially in a plane formed by the machined sub-assembly layer. The first feed network 255-*c* may also be extended to couple multiple waveguide device sub-arrays 200-*c* together by coupling a feed waveguide 254-*a* of the first feed network 255-*c* with a feed waveguide 254-*a* of an adjacent waveguide device sub-array 200-*c*.

FIG. 11B shows a top view 1100-*a* of first feed network 255-*c*. The dashed extension lines for feed waveguide 264-*a* illustrate how the first feed network 255-*c* may be extended to be coupled together with a first feed network 255-*c* of an adjacent sub-array to form a larger extended array without additional feed network layers.

Figure 12A:
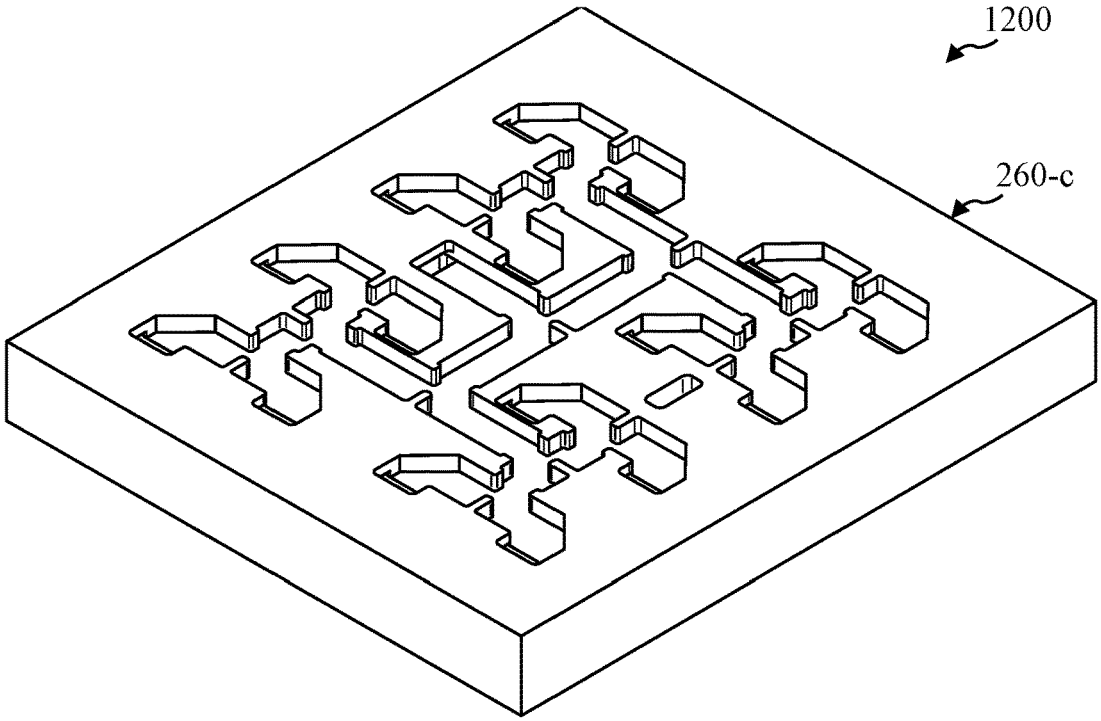
FIGS. 12A and 12B show views of second feed network in accordance with various embodiments.
Figure 12B:
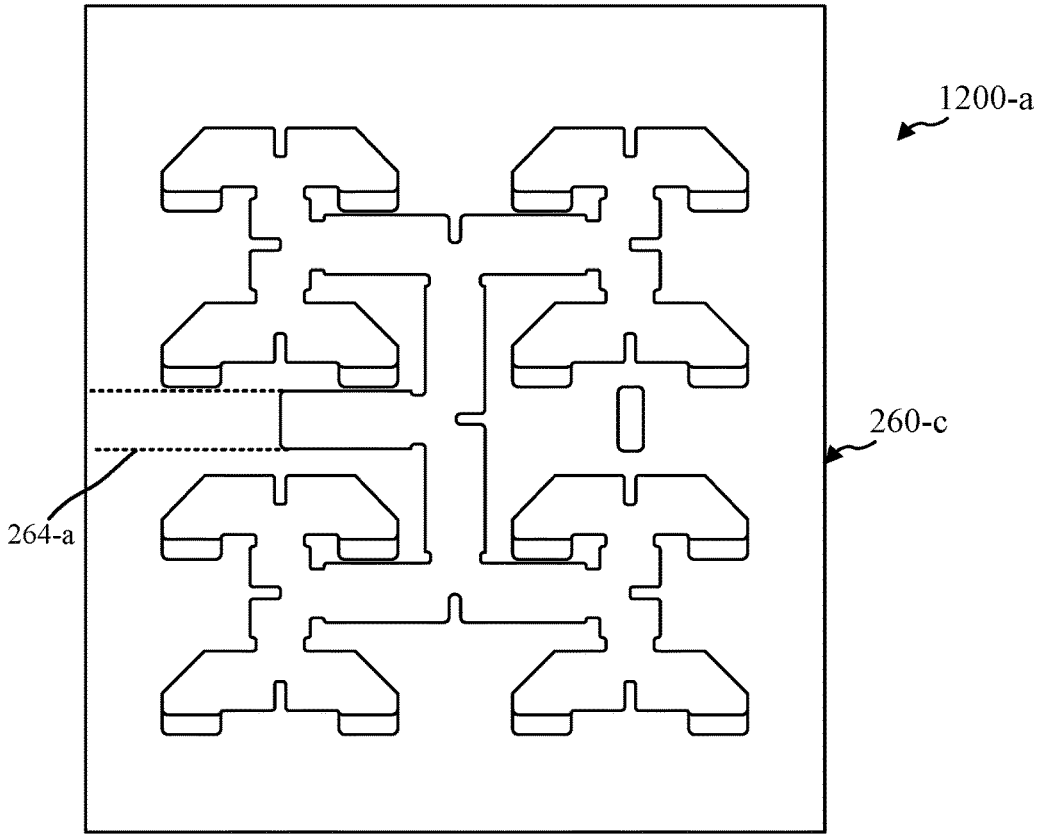

FIGS. 12A and 12B show views of a second feed network 260-*c* in accordance with various embodiments. The second feed network 260-*c* may be an example of the second feed network 260 of FIGS. 2, 8A-8E, 10A, and 10B. The second feed network 260-*c* may be used in an antenna array, such as the dual polarized planar horn antenna array 140 of FIG. 1.

FIG. 12A shows an isometric view 1200 of the second feed network 260-*c*. The second feed network 260-*c* may be a machined sub-assembly that has machined recesses forming planar waveguides (e.g., H-plane tees, etc.) that couples with the intermediate waveguides 240 for a waveguide device sub-array. The second feed network 260-*c* may be a corporate type feed network and lie substantially in the same plane as the first feed stage 255-*c*. The waveguide device 200-*c* may be formed by joining the section 1005 with the machined sub-assemblies forming the first feed network 255-*c* as shown in FIGS. 11A and 11B and second feed network 260-*c* as shown in FIGS. 12A and 12B.

FIG. 12B shows a top view 1200-*a* of second feed network 260-*c*. The dashed extension lines for feed waveguide 264-*a* illustrate how the second feed network 260-*c* may be extended to be coupled together with a second feed network 260-*c* of an adjacent sub-array to form a larger extended array without additional feed network layers.

Figure 13A:
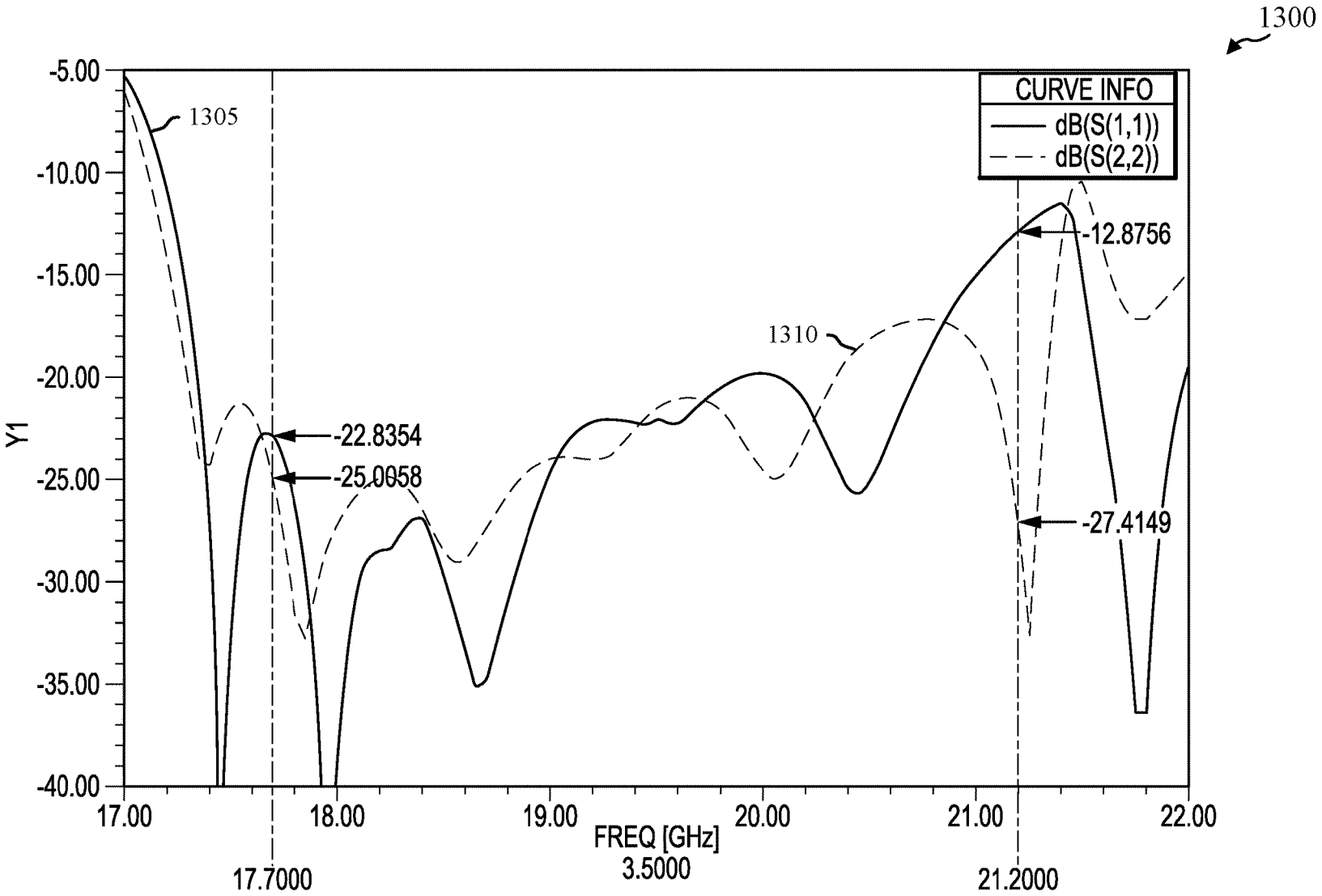
FIGS. 13A-13C show graphs of performance aspects of an example antenna array in accordance with various embodiments.
Figure 13B:
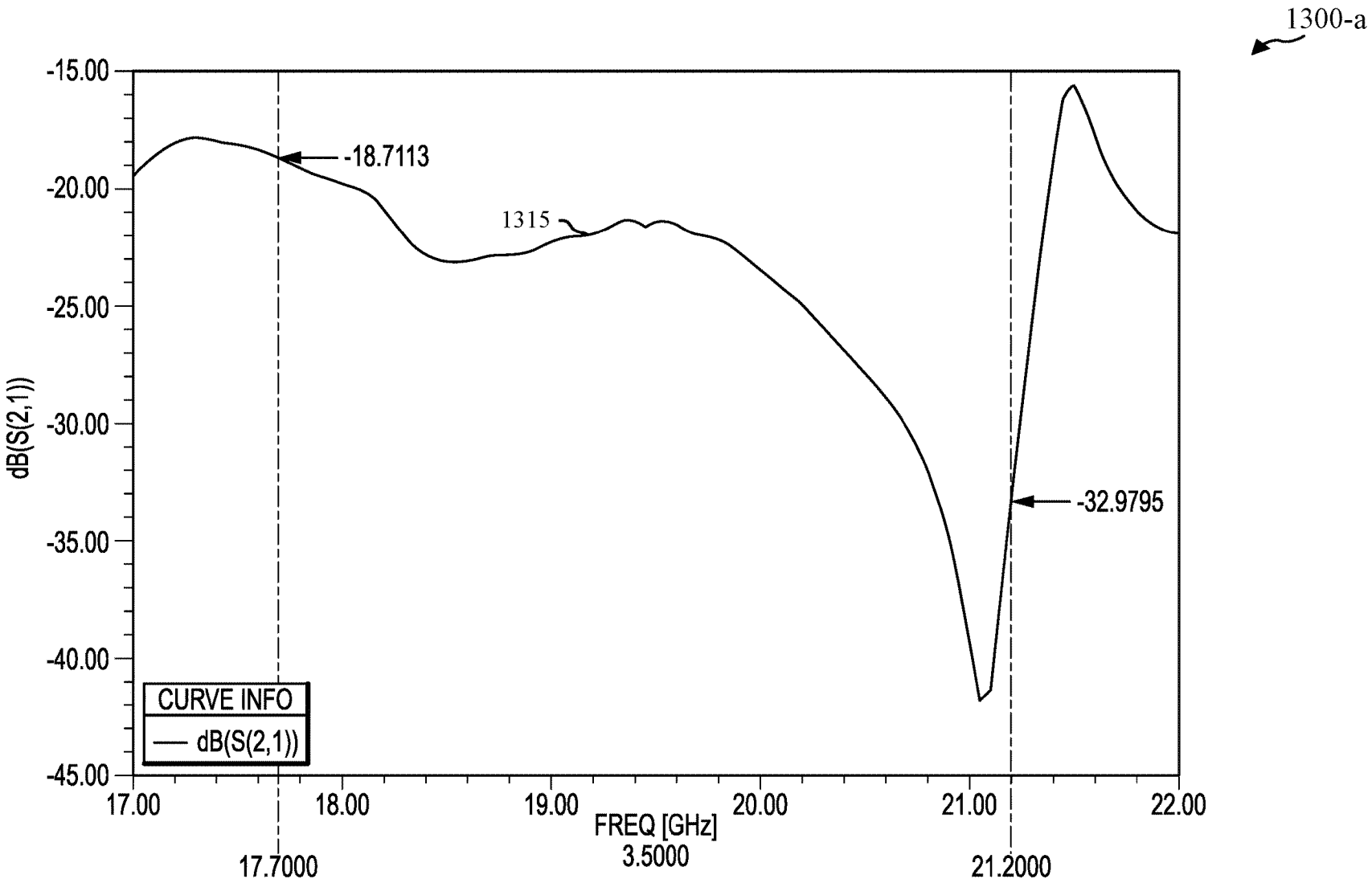
Figure 13C:
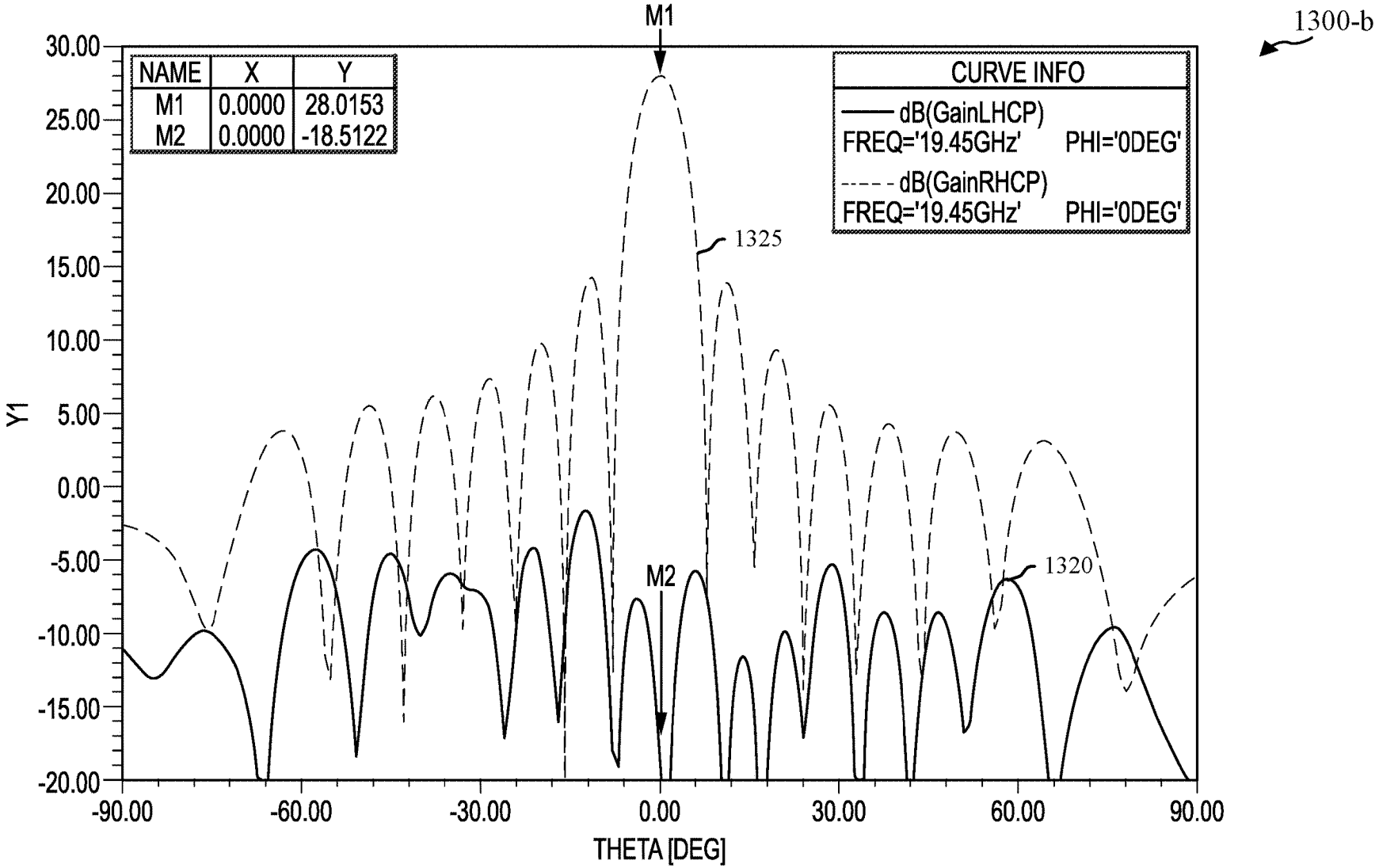

FIGS. 13A-13C show graphs of performance aspects of an example antenna array in accordance with various embodiments. The antenna array used to generate the performance aspects was an 8×8 antenna array. The antenna array may be an example of the dual polarized planar horn antenna array 140 of FIG. 1, the waveguide device 200 of FIGS. 8A-8E, 10A, and 10B, or the waveguide device 900 of FIG. 9.

FIG. 13A shows a graph 1300 of example performance aspects of an example antenna array in accordance with various embodiments. The graph 1300 illustrates the reflection coefficients of the antenna array. Particularly, the graph 1300 shows how much energy is reflected back at waveguide ports of the antenna array, such as the waveguide ports 252-*a* and 262-*a*. The graph 1300 charts a curve 1305 for the waveguide port 252-*a* corresponding to right-hand circular polarization and a curve 1310 for the waveguide port 262-*a* corresponding to left-hand circular polarization. The x-axis is the frequency of the radiation and the y-axis is the return energy. Lower values on the y-axis reflect better performance of the antenna array.

In this example, a bandwidth of interest may be 17.7 to 21.2 GHz. At 17.7 GHz, the reflected energy for the right-hand side (curve 1305) is −22.8354 dB. The reflected energy for the left-hand side (curve 1310) is −25.0058 dB at 17.7. At 21.2 GHz, the reflected energy for the right-hand side (curve 1305) is −12.8756 dB and the reflected energy for the left-hand side (curve 1310) is −27.4149 dB. The small differences between the curves 1305 and 1310 may be due to the slightly different lengths for the first and second feed networks, which may be appropriately corrected by additional waveguide tuning. These example values show good performance for the desired bandwidth. In other examples, other bandwidths may be of interest and other dB values may be achieved.

FIG. 13B shows a graph 1300-*a* of an example performance aspect of an example antenna array in accordance with various embodiments. The graph 1300-*a* illustrates energy received at the port 262-*a* when the port 252-*a* transmits. The graph 1300-*a* charts a curve 1315 for the transmission coefficient. The x-axis is the frequency of the radiation and the y-axis is the energy transmitted from one port to the other. Lower values on the y-axis reflect better performance of the antenna array. In this example, a bandwidth of interest is 17.7 to 21.2 GHz. At 17.7 GHz, the energy transmitted from one port to the other port is −18.7113 dB. At 21.2 GHz, the energy transmitted from one port to the other port is −32.9795 dB.

FIG. 13C shows a graph 1300-*b* of an example performance aspect of an example antenna array in accordance with various embodiments. The graph 1300-*b* illustrates a gain pattern when the waveguide port 252-*a* corresponding to right-hand circular polarization transmits. The graph 1300-*b* includes a curve 1320 for a cross-polar left-hand component of the gain and a curve 1325 for a co-polar right-hand component of the gain. The x-axis is an angle theta and the y-axis corresponds to the radiated energy. In this example, side lobes for the curves 1325 are small and reflect the absence of grating lobes of the antenna arrays described herein.

Figure 14:
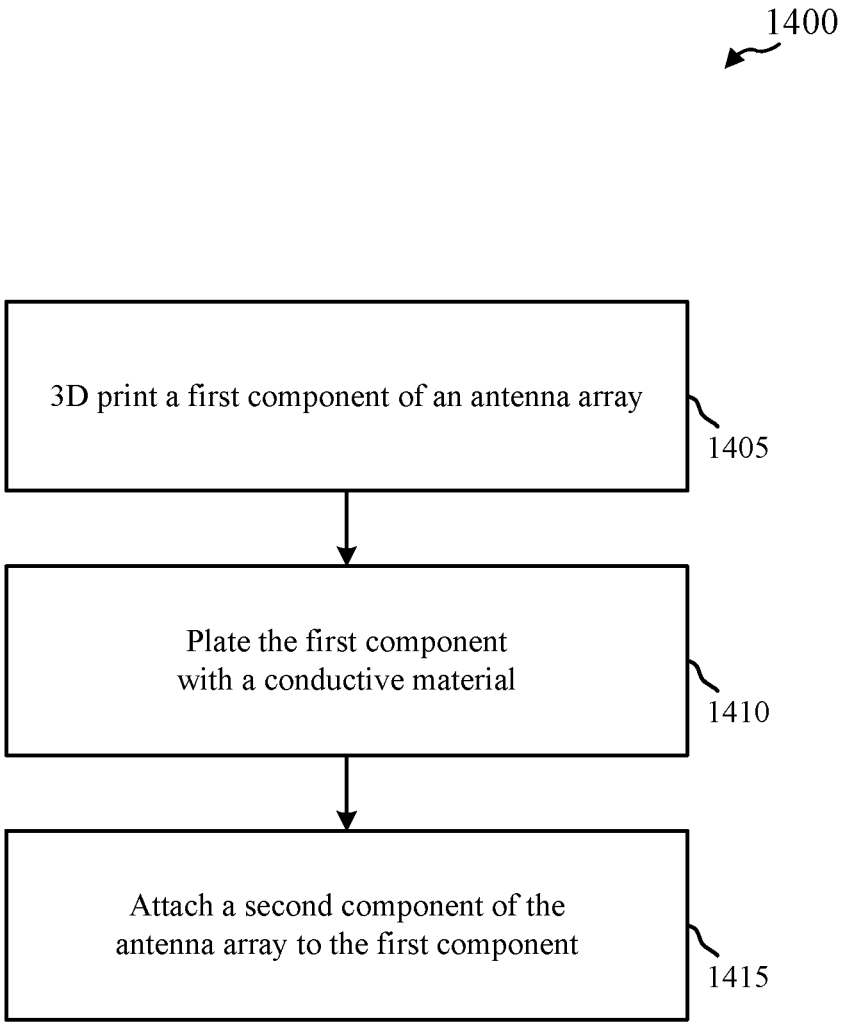
FIG. 14 shows a flowchart of an example method for manufacturing an antenna array in accordance with various embodiments.

FIG. 14 shows a flowchart of an example method 1400 for manufacturing an antenna array in accordance with various embodiments. The method 1400 may be used to create antenna arrays such as an example of the dual polarized planar horn antenna array 140 of FIG. 1 or the waveguide devices 200 or 900 of FIGS. 2, 8A-8E, 9, 10A, and 10B. In some examples, a processor may execute one or more sets of codes to control machining equipment to perform the functions described below.

The method 1400 may include 3D printing a first component of the antenna array at block 1405. The first component may be an array of waveguide elements or the array of waveguide elements and first waveguide feed stage. All the parts of the first component may be formed as a single component (i.e., the structure may form the waveguide components as an integral unit). The first component may be formed from a non-conductive material such as plastic. In one example, the first component includes the antenna elements 290, the combiner/dividers 225, 230, and the intermediate waveguides 235, 240 for a waveguide device sub-array 200. In some embodiments, the antenna elements 290 and intermediate waveguides 235, 240 have waveguide propagation directions that are substantially parallel to each other, thus forming a structure without significant hidden recesses as illustrated in FIGS. 10A and 10B.

At block 1410, the method 1400 may further include plating the first component with a conductive material. The conductive material may be metal, for example. The method 1400 may further include attaching a second component of the antenna array to the first component, at block 1415. The second component may be a feed network, such as a first feed network 255. In another example, the second component may be both the first feed network 255 and a second feed network 260. In another example, a third feed network is attached to the first component (or to another second component). In other examples, other devices needed to couple the antenna array with a transceiver or other equipment may be used with the antenna array.

Antenna arrays as described herein provide a way of grouping ports of polarization duplexers having the same polarization that allows compact dual-polarized waveguide feed structures. This topology brings the radiating elements close enough to avoid grating lobes while still being able to make a low profile antenna array waveguide device for a dual-polarized antenna array. The antenna arrays described herein may be scalable, both in size of the array as well as for different bandwidths.

The detailed description set forth above in connection with the appended drawings describes exemplary embodiments and does not represent the only embodiments that may be implemented or that are within the scope of the claims. The term "example" used throughout this description means "serving as an example, instance, or illustration," and not "preferred" or "advantageous over other embodiments." The detailed description includes specific details for the purpose of providing an understanding of the described techniques. These techniques, however, may be practiced without these specific details. In some instances, well-known structures and devices are shown in block diagram form in order to avoid obscuring the concepts of the described embodiments.

Information and signals may be represented using any of a variety of different technologies and techniques. For example, data, instructions, commands, information, signals, bits, symbols, and chips that may be referenced throughout the above description may be represented by voltages, currents, electromagnetic waves, magnetic fields or particles, optical fields or particles, or any combination thereof.

The functions described herein may be implemented in various ways, with different materials, features, shapes, sizes, or the like. Other examples and implementations are within the scope of the disclosure and appended claims. Features implementing functions may also be physically located at various positions, including being distributed such that portions of functions are implemented at different physical locations. Also, as used herein, including in the claims, "or" as used in a list of items (for example, a list of items prefaced by a phrase such as "at least one of" or "one or more of") indicates a disjunctive list such that, for example, a list of "at least one of A, B, or C" means A or B or C or AB or AC or BC or ABC (i.e., A and B and C).

The previous description of the disclosure is provided to enable a person skilled in the art to make or use the disclosure. Various modifications to the disclosure will be readily apparent to those skilled in the art, and the generic principles defined herein may be applied to other variations without departing from the scope of the disclosure. Thus, the disclosure is not to be limited to the examples and designs described herein but is to be accorded the widest scope consistent with the principles and novel features disclosed herein.

What is claimed is:

1. A waveguide device for a dual-polarized antenna array comprising:

a plurality of rows of common waveguides coupled with alternating pairs of adjacent rows of first waveguides associated with a first polarization and pairs of adjacent rows of second waveguides associated with a second polarization, wherein the plurality of rows of common waveguides are arranged in a plane that is perpendicular to a waveguide propagation direction of the common waveguides, wherein a set of two or more first waveguides from a first pair of adjacent rows of first waveguides is formed from first waveguides coupled with a first group of common waveguides from adjacent rows of common waveguides, wherein a set of two or more second waveguides from a second pair of adjacent rows of second waveguides is formed from second waveguides coupled with a second group of common waveguides from adjacent rows of common waveguides, and wherein the first group of common waveguides has a first row of common waveguides in common with the second group of common waveguides and has at least a second row of common waveguides that is not in the second group of common waveguides; and a waveguide feed network comprising:

a first waveguide feed stage comprising:

a first plurality of waveguide combiner/dividers, each of the first plurality of waveguide combiner/dividers coupled between a first intermediate waveguide and the set of two or more first waveguides; and a second plurality of waveguide combiner/dividers, each of the second plurality of waveguide combiner/dividers coupled between a second intermediate waveguide and of two or more second waveguides, wherein the second plurality of waveguide combiner/dividers are non-overlapping with the first plurality of waveguide combiner/dividers in directions parallel to the plane; and a second waveguide feed stage coupled with the first intermediate waveguides and the second intermediate waveguides.

2. The waveguide device of claim 1, wherein the first group of common waveguides are formed from adjacent columns of common waveguides, and wherein the second group of common waveguides are formed from the adjacent columns.

3. The waveguide device of claim 1, wherein the first group of common waveguides comprises common waveguides from two adjacent rows of common waveguides and two adjacent columns of common waveguides.

4. The waveguide device of claim 1, wherein the second waveguide feed stage comprises:

a first feed network coupled with the first intermediate waveguides; and a second feed network coupled with the second intermediate waveguides.

5. The waveguide device of claim 1, wherein the first polarization is a right-handed circular polarization and the second polarization is a left-handed circular polarization.

6. The waveguide device of claim 1, wherein the first polarization is a first linear polarization and the second polarization is a second linear polarization orthogonal to the first linear polarization.

7. The waveguide device of claim 1, wherein each common waveguide is located a same inter-element distance from at least two adjacent common waveguides.

8. The waveguide device of claim 1, wherein each common waveguide is divided into a first waveguide associated with the first polarization and a second waveguide associated with the second polarization by a septum polarizer.

9. The waveguide device of claim 8, wherein:

the dual-polarized antenna array is a lattice antenna array;

a first row of the dual-polarized antenna array has common waveguides each having a septum polarizer in a first orientation; and a second, adjacent row of the dual-polarized antenna array has common waveguides each having a septum polarizer in a second orientation, wherein the second orientation is opposite the first orientation.

10. The waveguide device of claim 8, wherein each of the plurality of rows of common waveguides have septum polarizers inverted by rotation around a longitudinal axis relative to septum polarizers in an adjacent row of the plurality of rows of common waveguides.

11. The waveguide device of claim 1, wherein there are no second waveguides located between the first waveguides of a first pair of adjacent rows of first waveguides, and wherein there are no first waveguides located between the second waveguides of a second pair of adjacent rows of second waveguides.

12. The waveguide device of claim 1, wherein a row of common waveguides is coupled with a row of the first waveguides associated with the first polarization and a row of the second waveguides associated with the second polarization.

13. A waveguide device for a dual-polarized antenna array comprising:

a plurality of rows of common waveguides coupled with alternating pairs of adjacent rows of first waveguides associated with a first polarization and pairs of adjacent rows of second waveguides associated with a second polarization, wherein the plurality of rows of common waveguides are arranged in a plane that is perpendicular to a waveguide propagation direction of the common waveguides; and a waveguide feed network comprising:

a first waveguide feed stage comprising:

a first plurality of waveguide combiner/dividers, each of the first plurality of waveguide combiner/dividers coupled between a first intermediate waveguide and first waveguides of a first pair of adjacent rows of first waveguides; and a second plurality of waveguide combiner/dividers, each of the second plurality of waveguide combiner/dividers coupled between a second intermediate waveguide and second waveguides of a second pair of adjacent rows of second waveguides, wherein the second plurality of waveguide combiner/dividers are non-overlapping with the first plurality of waveguide combiner/dividers in directions parallel to the plane; and a second waveguide feed stage coupled with the first intermediate waveguides and the second intermediate waveguides, wherein the second waveguide feed stage comprises:

a first feed network coupled with the first intermediate waveguides, the first feed network comprising a third plurality of waveguide combiner/dividers coupled between the first intermediate waveguides and a first feed network port of the waveguide feed network; and a second feed network coupled with the second intermediate waveguides, the second feed network comprising a fourth plurality of waveguide combiner/dividers coupled between the second intermediate waveguides and a second feed network port of the waveguide feed network.

14. The waveguide device of claim 13, further comprising:

a third feed network comprising a fifth plurality of waveguide combiner/dividers coupled with the first feed network port of the waveguide feed network and coupled with at least one other waveguide feed network associated with the second plurality of waveguide combiner/dividers; and a fourth feed network comprising a sixth plurality of waveguide combiner/dividers coupled with the second feed network port of the waveguide feed network and coupled with the at least one other waveguide feed network associated with the second plurality of waveguide combiner/dividers.

15. The waveguide device of claim 13, wherein at least a portion of the first feed network is located between the first intermediate waveguides and the second feed network.

16. The waveguide device of claim 13, wherein the first and second feed networks comprise a plurality of 2-to-1 waveguide combiner/dividers.

17. A waveguide device for a dual-polarized antenna array comprising:

a plurality of rows of common waveguides coupled with alternating pairs of adjacent rows of first waveguides associated with a first polarization and pairs of adjacent rows of second waveguides associated with a second polarization, wherein the plurality of rows of common waveguides are arranged in a plane that is perpendicular to a waveguide propagation direction of the common waveguides;

a waveguide feed network comprising:

a first waveguide feed stage comprising:

a first plurality of waveguide combiner/dividers, each of the first plurality of waveguide combiner/dividers coupled between a first intermediate waveguide and first waveguides of a first pair of adjacent rows of first waveguides; and a second plurality of waveguide combiner/dividers, each of the second plurality of waveguide combiner/dividers coupled between a second intermediate waveguide and second waveguides of a second pair of adjacent rows of second waveguides, wherein the second plurality of waveguide combiner/dividers are non-overlapping with the first plurality of waveguide combiner/dividers in directions parallel to the plane; and a second waveguide feed stage coupled with the first intermediate waveguides and the second intermediate waveguides, wherein:

a first row of first waveguides in the first pair of adjacent rows of first waveguides is coupled to a first row of common waveguides;

a second row of first waveguides in the first pair of adjacent rows of first waveguides is coupled to a second row of common waveguides;

a first row of second waveguides in the second pair of adjacent rows of second waveguides is coupled to the second row of common waveguides; and a second row of second waveguides in the second pair of adjacent rows of second waveguides is coupled to a third row of common waveguides.

* * * * *